US005800310A

United States Patent [19]

Jones

[11] Patent Number: 5,800,310

[45] **Date of Patent: *Sep. 1, 1998**

[54] MACHINE AND METHOD FOR MEASURING STRENGTH OF MUSCLES WITH AID OF A COMPUTER

[75] Inventor: Arthur A. Jones, Ocala, Fla.

[73] Assignee: MED-X 96, Inc., Ocala, Fla.

[ * ] Notice: The term of this patent shall not extend beyond the expiration date of Pat. No. 4,902,009.

[21] Appl. No.: 436,752

[22] Filed: May 8, 1995

Related U.S. Application Data

[63] Continuation of Ser. No. 947,284, Sep. 15, 1992, Pat. No. 5,667,463, which is a continuation-in-part of Ser. No. 909, 658, Jul. 7, 1992, Pat. No. 5,256,125, which is a continuation-in-part of Ser. No. 813,531, Dec. 26, 1991, Pat. No. 5,149,313, which is a continuation of Ser. No. 637,618, Jan. 4, 1991, Pat. No. 5,092,590, which is a division of Ser. No. 422,905, Oct. 18, 1989, Pat. No. 5,005,830, which is a division of Ser. No. 236,367, Aug. 25, 1988, Pat. No. 4,902,009, which is a continuation-in-part of Ser. No. 60,679, Jun. 11, 1987, Pat. No. 4,836,536, and Ser. No. 181,372, Apr. 14, 1988, Pat. No. 4,834,365.

[51] Int. Cl.[6] ..... A63R 23/02; A61B 5/22

[52] U.S. Cl. ..... 482/8; 482/100; 482/133; 482/134; 482/137; 482/901; 482/902; 482/91; 73/379.01

[58] Field of Search ..... 482/8, 9, 91, 909, 482/134, 100, 137, 133, 901, 902; 73/379.01, 379.06, 379.08, 379.09

[56] References Cited

U.S. PATENT DOCUMENTS

| | | | |
|---|---|---|---|
| 4,333,340 | 6/1982 | Elmeskog | 73/379.01 |
| 4,462,252 | 7/1984 | Smidt et al. | 73/379.01 |
| 4,732,038 | 3/1988 | DelGiornd et al. | 73/379.01 |
| 4,763,897 | 8/1988 | Yakata | 482/100 |
| 4,869,497 | 9/1989 | Stewart et al. | 482/9 X |
| 4,912,638 | 3/1990 | Pratt, Jr. | 482/9 |

OTHER PUBLICATIONS

Schwarzenegger, A and bill Bobbins. 1885. *Encyclopedia of Modern bodybuilding*. New York: Simon & Schuster pp. 118–119.

Darden, Ellington. 1980. *The Nautilua Book*. Chicago: Contemporary Books: pp. 27, 57 & 58.

Vos, J.A., and H.P. Kimmich, 1971, Telemetry of Biomechanical Forces During Exercise, *International Symposium on Biotelemetry:* 279–288.

*Primary Examiner*—Richard J. Apley
*Assistant Examiner*—John Mulcahy
*Attorney, Agent, or Firm*—William E. Mouzavires

[57] ABSTRACT

Method and apparatus for testing the muscle strength of a subject wherein both static and dynamic strength tests are conducted on the subject during which forces exerted by the muscles are measured by devices which are connected to a computer and a display screen for displaying the strength of the muscles at different positions of a subject's body part. In the dynamic strength test, the subject moves a movement arm by exerting the muscles to be tested. The movement arm is connected to a resistance weight to oppose movement by the subject. In the static strength test, the movement arm is fixed in position and the subject exerts a body part against the movement arm upon exertion of the muscles to be tested. Force and angle measuring devices are connected to the movement arm and the computer for enabling the muscle strength to be displayed in terms of torque at various angular positions of the body part.

34 Claims, 16 Drawing Sheets

MACHINE AND METHOD FOR MEASURING STRENGTH OF MUSCLES WITH AID OF A COMPUTER

RELATED APPLICATIONS

This application is a continuation of my prior co-pending application, Ser. No. 07/947,284, filed Sep. 15, 1992 entitled EXERCISE MACHINES AND METHODS, now U.S. Pat. No. 5,667,463, which is a continuation-in-part of my prior application, Ser. No. 07/909,658, filed Jul. 7, 1992 entitled BICEPS CURL MACHINE, now U.S. Pat. No. 5,256,125 which is a continuation-in-part of my prior application, Ser. No. 07/813,531, now U.S. Pat. No. 5,149,313 filed Dec. 26, 1991, which is a continuation of my prior application, Ser. No. 07/637,618, filed Jan. 4, 1991, now U.S. Pat. No. 5,092,590, which is a division of my prior co-pending application, Ser. No. 07/422,905, filed Oct. 18, 1989, now U.S. Pat. No. 5,005,830 which in turn is a division of my prior application, Ser. No. 07/236,367 filed Aug. 25, 1988, now U.S. Pat. No. 4,902,009, entitled MACHINE FOR EXERCISING AND/OR TESTING MUSCLES OF THE LOWER TRUNK, AND METHOD which in turn is a continuation-in-part of my prior U.S. patent application, Ser. No. 07/060,679, filed Jun. 11, 1987, now U.S. Pat. No. 4,836,536 and Ser. No. 07/181,372, filed Apr. 14, 1988, now U.S. Pat. No. 4,834,365 and entitled COMPOUND WEIGHT SYSTEM. The disclosures of my above-identified patent applications are hereby incorporated by reference into the instant application as part hereof.

FIELD OF THE PRESENT INVENTION

The present invention generally relates to machines and methods for exercising and measuring the strength of muscles of the human body. The muscles involved can be any of the muscles of the human body such as, for example, lumbar, abdominal, arm, neck, biceps, and other muscles and therefore the present invention is not limited to any specific muscles. The machine and method of the present invention are of the type that typically involve a movement arm that is movable against a resistance, preferably a weight resistance. The subject exerts the muscles whose strength is to be measured, to move a portion of the subject's body against the resistance.

OBJECTS OF THE PRESENT INVENTION

An object of the present invention is to provide novel and improved methods and apparatus for measuring the strength of muscles of the human body. Included herein are such methods and apparatus which accurately measure muscle strength in a safe and effective manner.

Another object of the present invention is to provide novel and improved methods and apparatus of measuring the static and dynamic strength of muscles of the human body.

Another object of the present invention is to provide novel method and apparatus which facilitate the accurate measurement and display of the strength of a subject's muscles during an exercise of the muscles.

SUMMARY OF THE PRESENT INVENTION

In summary the present invention provides method and apparatus for measuring the strength of a subject's muscles in conjunction with a computer which receives information from an exercise machine when the subject exerts the muscles against a resistance included in the machine. In one mode of the machine and method, the subject exerts forces against a resistance which is fixed against movement. A force measuring device such as a strain gauge responds to the forces and sends information to a computer which processes the information and makes calculations for displaying the strength of the muscles on a display screen. In another mode of the machine and method, the resistance is free to move in response to the subject exerting forces against the resistance. Here again a force measuring device such as a strain gauge will measure the force applied to the resistance and feed this information to the computer which will process the information for display on the screen. In addition an angle measuring device is included in the machine for measuring the angle of the subject's body part acting against the resistance. The information is fed into the computer thus allowing the strength of the subject's muscles to be displayed on a screen with respect to different angular positions of the body part.

DRAWINGS

Other objects and advantages of the present invention will become apparent from the following, more detailed description taken in conjunction with the attached drawings in which.

DETAILED DESCRIPTION

Figure 1:
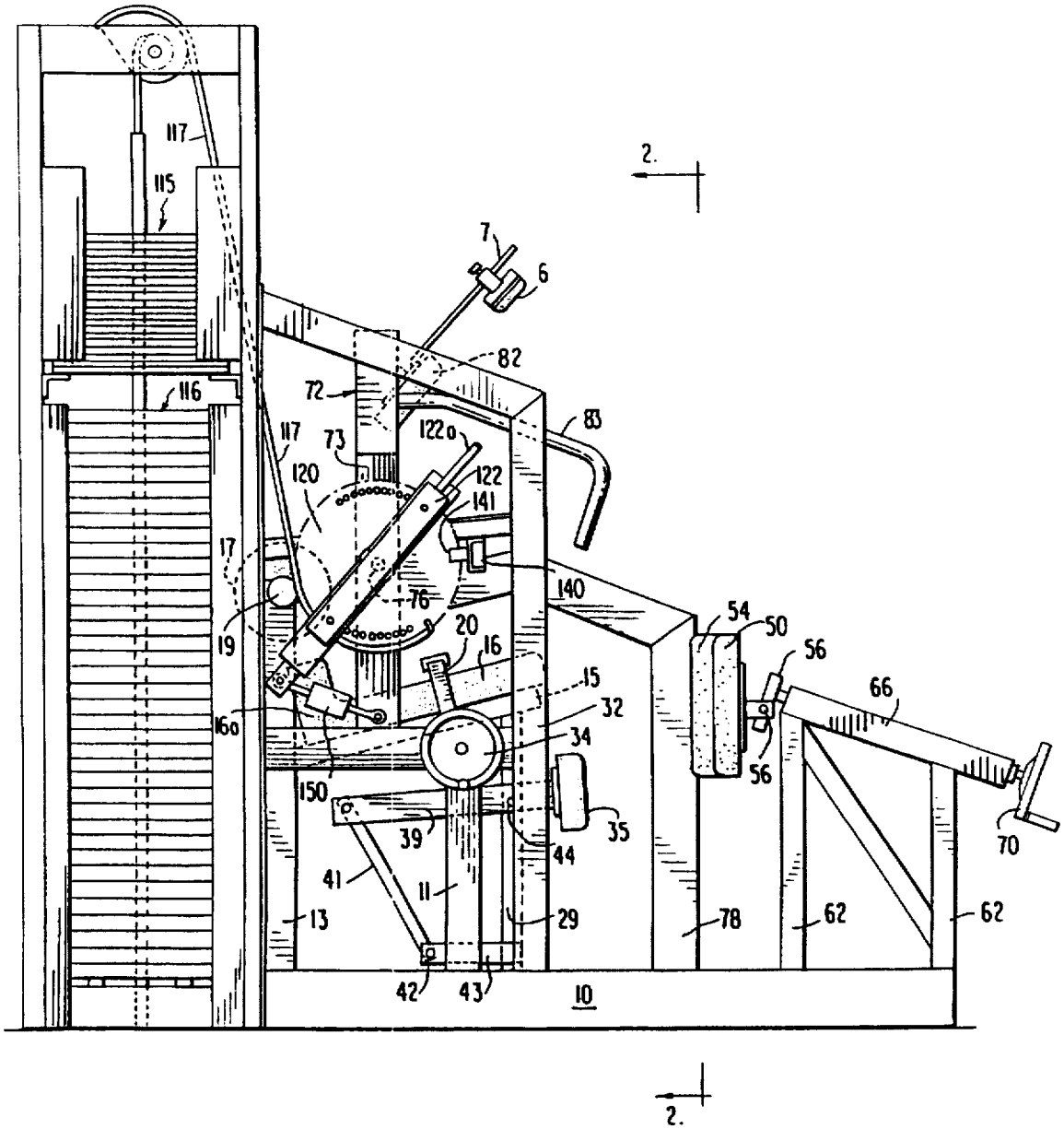
FIG. 1 is a side elevational view of a machine embodying the present invention for exercising and/or testing the lumbar muscles of the human body and constituting a preferred lumbar machine of the present invention.

Referring now to the drawings in detail there is shown in FIGS. 1–9, for illustrative purposes, one preferred embodiment of a machine of the present invention for exercising and testing the lumbar muscles of the lower trunk of the human body.

SEAT AND PELVIC RESTRAINT PAD

Figure 2:
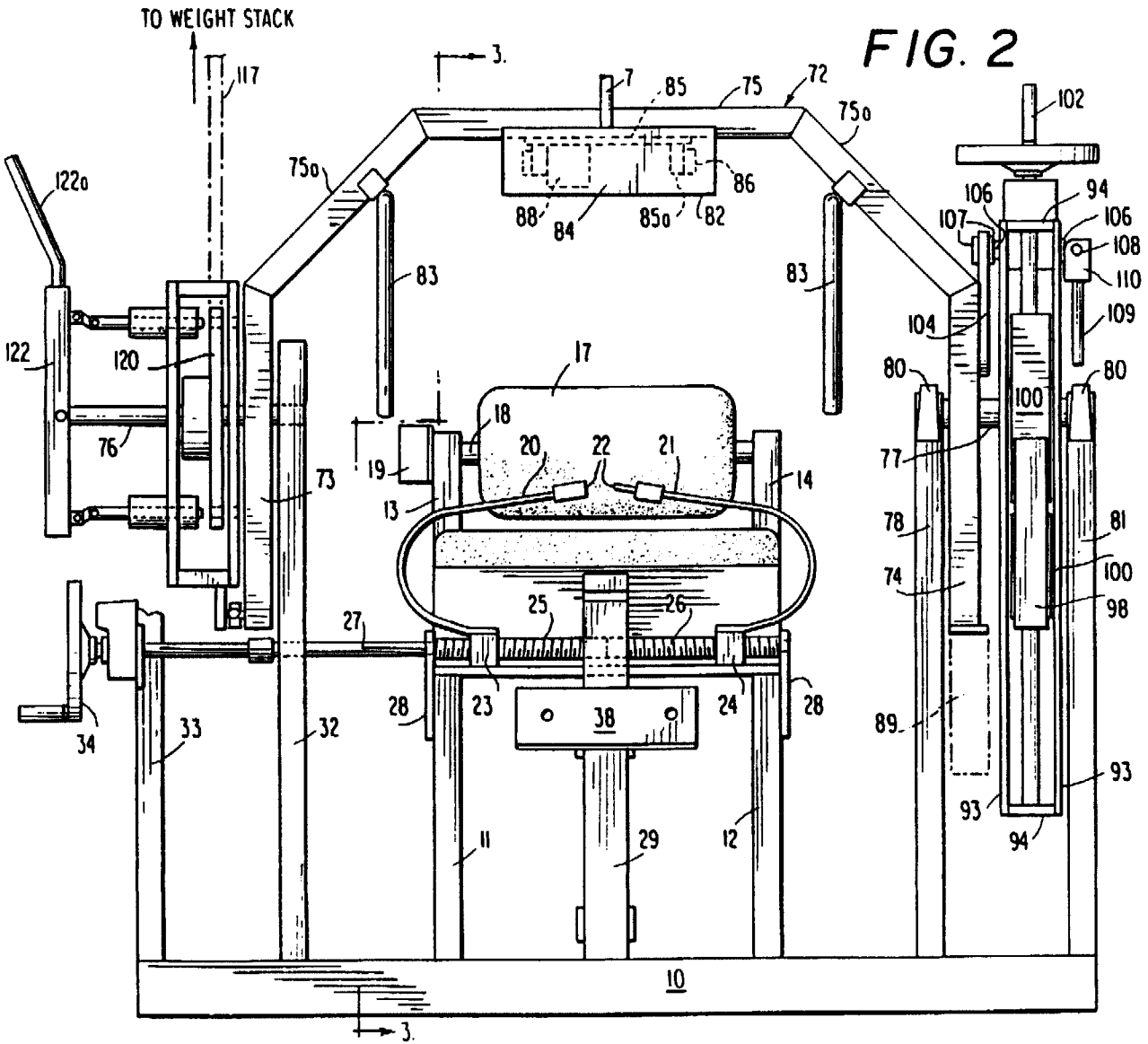
FIG. 2 is a cross-sectional view taken generally along lines 2—2 of FIG. 1.
Figures 3, 5, 6:
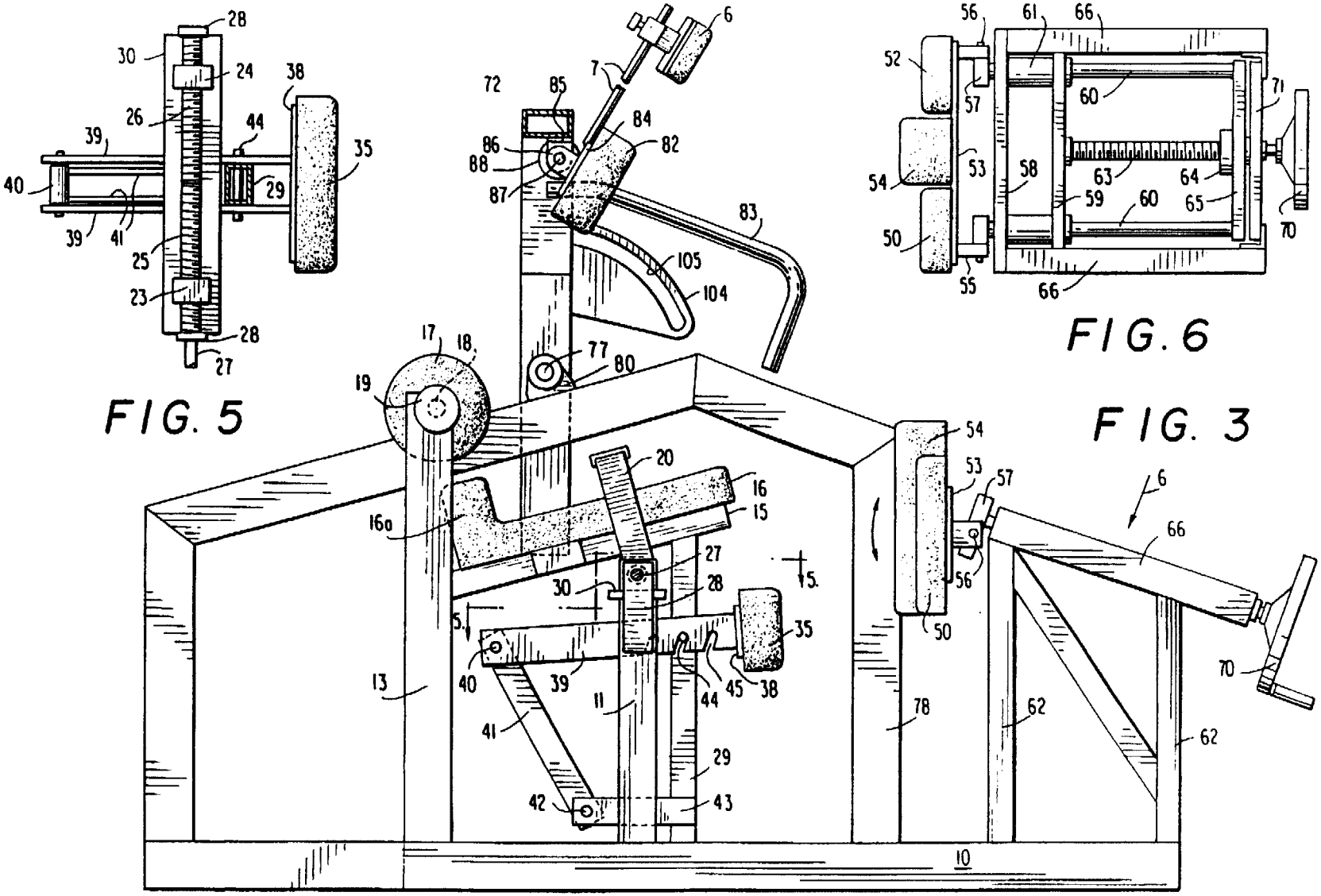
FIG. 3 is a cross-sectional view taken generally along lines 3—3 of FIG. 2.
FIG. 5 is a cross-sectional view taken generally along lines 5—5 of FIG. 3.
FIG. 6 is a fragmental view in the direction of arrow 6 of FIG. 3.

Referring initially to FIGS. 1, 2 and 3, the machine includes a horizontal base 10 having generally centered thereon a seat assembly including upstanding front legs 11 and 12 and rear legs 13 and 14 supporting a seat frame 15 carrying a suitable padded seat 16 which extends rearwardly downwardly at an angle of about 15° (degrees). Seat 16 includes a small upstanding rear rest 16*a* for positioning the buttocks and the pelvis, and just above the rear rests 16*a* is a pelvic restraint pad 17 mounted on a shaft 18 at the elevation of the pelvis for restraining the pelvis against rearward movement. Shaft 17 is suitably mounted for rotation in the rear legs 13 and 14 with the pelvic pad 17 fixed to the shaft for rotation therewith. For reasons to become clear below, and in accordance with a feature of the present invention, the pad 17 is rotatable to detect any unwanted movement of the pelvis during an exercise or test. Rotation of the pelvic pad 17 may be detected in any suitable manner such as, for example, by a goniometer 19 mounted to shaft 18 as shown in FIG. 2.

THIGH RESTRAINT

In order to further restrain the pelvis against movement, a pair of thigh straps 20 and 21 are provided over the seat as shown in FIG. 2. A suitable buckle assembly 22 is provided on the upper ends of the thigh straps to releasably connect them over the thighs of the exerciser. Thigh straps 20, 21 are suitably tensioned by means of a non-advancing screw mechanism best shown in FIGS. 2 and 5. The mechanism includes left and right-handed screw portions 25 and 26 formed on a shaft 27 below the seat 16 with non-turning nuts 23 and 24 threaded on screw portions 25 and 26 respectively. Nuts 23 and 24 rest on and are prevented from rotating by a flat plate 30 which extends horizontally below the screw portions and is fixed to legs 11 and 12. The lower ends of thigh straps 20 and 21 are fixed to nuts 23 and 24 respectively such that rotation of screw portions 25 and 26 will cause the nuts 23, 24 to move towards or away from each other depending on the direction of rotation of shaft 27 to loosen or tighten the thigh straps, 20, 21. As the nuts 23 and 24 are square with four flat sides, the plate 30 which engages one of the flat sides of the nuts will prevent rotation of the nuts thus causing the nuts to only advance or retract along the screw portions upon rotation of the shaft 27. Shaft 27 is mounted for rotation in plates 28 fixed to the legs 11 and 12. Additionally, shaft 27 extends outwardly wherein it is also supported by vertical frames 32 and 33 upstanding from base 10 as shown in FIG. 2. Rotation of shaft 27 to actuate the thigh straps 20, 21 is effected by a handwheel fixed to the shaft 27 outwardly of frame 33.

LEG AND PELVIC RESTRAINT

Referring to FIGS. 3 and 5, the rear of the legs are supported and restrained generally at the calves by what will be termed a "calf pad" 35 fixed to a mounting plate 38 below the seat. Mounting plate 38 is fixed across the front end of a pair of parallel support links 39 whose rear ends are pivotably mounted by pivot 40 to vertical links 41 which, in turn, are pivotally mounted by pivot 42 to base links 43. The latter are fixed to the bottom of a stationary vertical leg 29 which is centered below the seat and fixed to and between the base 10 and seat frame 15 as shown in FIGS. 2 and 3. It will thus be seen that links 39 and 41 form a linkage for extending or retracting the calf pad 35 to suit the size of a particular exerciser. In the specific embodiment shown, the several possible positions of the calf pad 35 are determined by slots 45 notched into the lower edges of links 39 to receive a pin 44 fixed in and projecting from opposite sides of the leg 29 as best shown in FIG. 5; it being understood that the links 39 straddle the opposite sides of leg 29.

In order to anchor the pelvis against movement, leg restrainers including pads 50 and 52 are provided in front of the seat 16 to engage the front of the legs below the knees and to impose a force against the femurs to hold the rear ends of the femurs downward which, in turn, anchors the pelvis since the rear ends of the femurs are connected to the pelvis. The slope and height of seat 16 is designated such that when one is seated, the tops of the thighs should be approximately horizontal which means that the midline of the femurs will be sloping upwards from their pelvic sockets at an angle of about 10° (degrees), with the knee-ends of the femurs slightly higher than the hip ends of the femurs. In accordance with the present invention, the leg pads 50, 52 which may be termed "shin pads", drive the femurs in an upward and rearward direction at an angle of about 30° (degrees) as shown in FIG. 3 in relation to the midline of the femurs, thus rotating the femurs about the thigh straps 20, 21 which form a fulcrum, to rotate the hip-ends of the femurs downwardly to thus hold the pelvis down against any movement.

Referring to FIGS. 3 and 6, in the present embodiment shown, the shin pads 50, 52 are fixed to a mounting plate 53 which, in turn, is mounted to a slide assembly to drive the pads forwardly or rearwardly. Between pads 50, 52 is a pad 54 received between the legs to properly space the legs and to prevent movement of the legs toward each other. The mounting plate 53 is provided with apertured ears 55 mounted by pivots 50 to lugs 57 fixed on the front of a slide including a pair of parallel slide rods 60 extending forwardly and upwardly at an angle to about 20° (degrees) and with their rear ends connected by a yoke 65. The forward ends of slide rods 60 are slidably received in a pair of bushings 61 fixed between a pair of cross supports 58 and 59 extending between and fixed to a pair of side frame rails 66 which are supported in fixed position by legs 62 upstanding from base 10. Slide rods 60 are actuated forwardly or rearwardly to advance or retract shin pads 50, 52 by means of a non-advancing screw 63 having one end rotatably held in cross-piece 59 and an opposite end threaded in a non-rotating nut 64 fixed to yoke 65. The rear end of the screw 63 extends through a cross frame piece 71 fixed to and between frame rails 66. Rotation of screws 63 by means of a hand wheel 70 will move yoke 65 and slide rods 60 to advance or retract the shin pads depending on the direction of rotation of the screw 63. Because of the forward and upward angle of the slide rods 60, the shin pads 50, 52 when advanced, will have the effect of rotating the femurs about the thigh strap as a fulcrum, to drive the hip-ends of the femurs rearwardly and downwardly to, in turn, securely anchor the pelvis against movement. During such action, the thighs will be prevented from upward movement by the thigh straps 20, 21 and the rear of the pelvis will be restrained by the seat 16, pelvic pad 17 and the rear seat rest 16*a*.

THE MOVEMENT ARM

Figure 7:
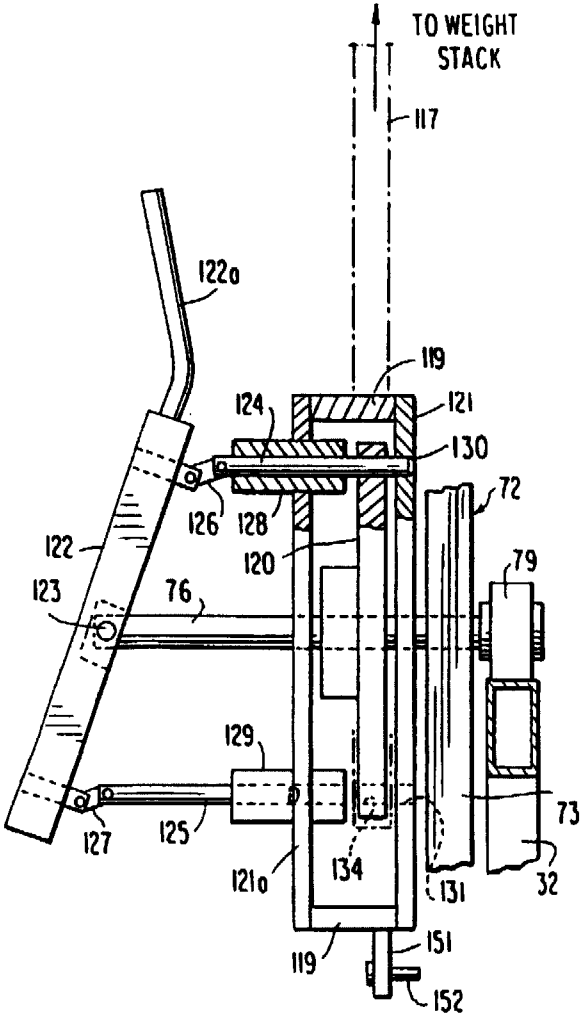
FIG. 7 is an enlarged, fragmental partly cross-sectional view of the left-hand portion of FIG. 2.

The forces generated by the lumbar muscles are transmitted to a movement arm generally designated 72 to pivot the movement arm about a horizontal axis. The movement arm has a generally inverted U-shape including opposite sides 73 and 74 positioned on opposite sides of the seat 16 and a crosspiece or yoke overlying the seat 16 and connected to the sides 73 and 74. In the specific embodiment shown, the yoke includes a horizontal top piece 75 and angled end portions 75*a* interconnecting the top piece 75 and the sides 73 and 74. The pieces of the movement arm 72 in the preferred embodiment are made from tubular steel or aluminum alloy welded together into a rigid structure. The movement arm is mounted for pivotal movement about a horizontal axis by shafts 76 and 77 respectively received through the sides 73 and 74 of the movement arm. Referring to FIGS. 7 and 2, shaft 76 is journalled in a bearing 79 fixed on stationary frame 32 while the other shaft 77 is journalled in two bearings 80 fixed to stationary frames 78 and 81 in laterally spaced relation on opposite sides of the movement arm to accommodate a counterweight assembly mounted to the shaft 77 as will be described below. Movement arm 72 is rotatable about shaft 77 and a suitable bearing is provided therebetween.

During an exercise of static strength test, the forces exerted by the lumbar muscles are transmitted to the movement arm 72 by what is termed herein a resistance pad 82 mounted centrally of the top crosspiece 75 on the inside thereof to be engaged by the back. The work capacity of the lumbar muscles during an exercise is measured in terms of foot pound seconds with the aid of a computer and to determine the foot pounds or torque applied by the lumbar muscles, it is necessary to determine the lever arm or distance between the point of application of the force to the movement arm at the resistance pad 82 and the pivotal axis of the spine as it moves through a predetermined range of movement between a generally upright or forwardly bent position and a rearwardly extended position. However, as the length and pivotal axis of the spine changes during the aforementioned exercise movement, it is necessary to compensate for such changes. In accordance with another aspect of the present invention, the resistance pad 82 is mounted to the movement arm to be rotatable relative thereto, and the angular movement of the resistance pad is measured as the exercise proceeds, to determine the length of the effective lever arm of the forces applied to the movement arm. In the preferred embodiment, the resistance pad is mounted to the movement arm by a plate 84 having apertured lugs 86 pivoted by pivots 87 to apertured flanges 85*a* of a mounting plate 85 fixed to the underside of the top crosspiece 75 of the movement arm as shown in FIGS. 2 and 3. Mounted on the resistance pad 82 in association with one of the pivots 87 is a goniometer 88 for measuring the angular movement of the resistance pad relative to the movement arm during an exercise.

Since the head and arms constitute a meaningful part of the total body mass, and since unwanted relative movement of either the head and arms or both will change the body mass torque, it follows that the head and arms must remain in a fixed position relative to the movement arm during a test or exercise. In the preferred embodiment shown, the arms are fixed in position by means of a pair of bars 83 fixed to the movement arm 72 and extending forwardly from the opposite sides thereof to be conveniently grasped by the hands at handle portions located at the forward extremities of the bars 83. The head is held in fixed position by contoured pad 6 adjustably mounted on a rod 7 fixed centrally to the mounting plate 84 of the resistance pad 82.

In order to eliminate the effect of torque that would otherwise be imposed by the mass of the movement arm 72 itself, a fixed counterweight 89 is connected to one of the sides 73 of the movement arm below the horizontal pivot axis of the movement arm which axis is, of course, determined by pivot shafts 76 and 77.

ADJUSTABLE COUNTERWEIGHT ASSEMBLY

Figure 4:
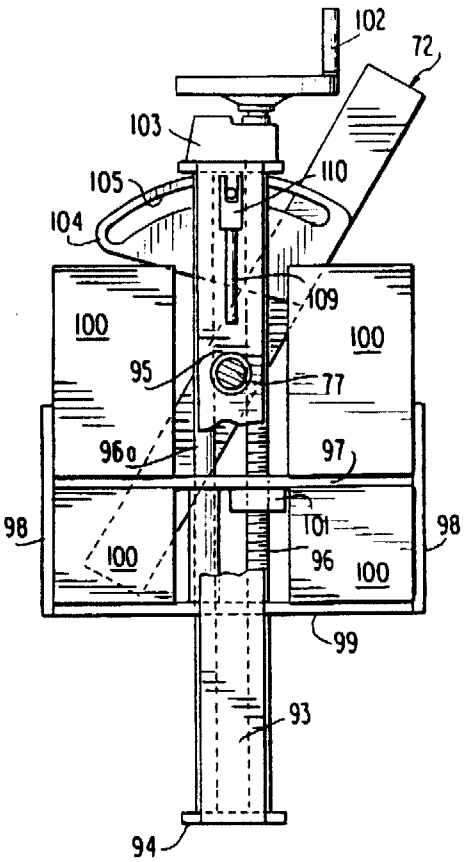
FIG. 4 is a fragmental side elevational view of the machine as shown in FIG. 2.

Since the torso mass of the persons using the machine will vary from person to person, it is necessary to provide an adjustable counterweight in order to balance out the effect of the torque produced by the torso mass of the person using the machine. In the preferred embodiment as shown in FIGS. 2 and 4, there is provided an adjustable counterweight assembly including an elongated frame mounted for rotation about pivot shaft 77 between bearings 80 and including a pair of elongated side plates 93 fixed between top and bottom end plates 94. Side plates 93 are apertured at 95 to receive pivot shaft 77 as shown in FIG. 4, and on opposite sides of shaft 77 there is provided an elongated actuating screw 96 and a guide rod 96*a*. Mounted to the actuating screw 96 is a weight carrier including opposite end plates 98 vertically upstanding from a base plate 99 and interconnected by a horizontal divider plate 97 to define upper and lower compartments on opposite sides of the screw and guide rod assembly 96, 96*a* for receiving weights 100, there being four weights 100 shown in FIG. 4. A non-rotating nut 101 is fixed to the divider plate 97 such that upon rotation of the screw 96, the weight carrier will be raised or lowered depending upon the direction of rotation of the screw 96. A hand wheel 102 is connected through suitable gearing in a housing 103 to the upper end of the screw 96 for rotating the screw, and a register is provided in the gear housing 103 to give a visible display of the position of the weight carrier along the screw to indicate when the torso mass has been balanced by the counterweight assembly.

Prior to adjusting the counterweight assembly to balance out the weight of the torso mass of the person exercised or tested, it is necessary to align the centerline of the torso mass (extending through the center of mass of the torso) with the centerline of the couterweight assembly (extending through the center of mass thereof). This is achieved by positioning the person after restrained (on the seat 16 as described above) at top dead center with the movement arm 72 at rest. The counterweight assembly is then connected to the movement arm 72 by means of a releasable coupling. In the preferred embodiment shown, this coupling includes a pressure plate 104 fixed to the side 74 of the movement arm 72 and having an arcuate slot 105 (see FIG. 4) extending in the pivotal direction of the movement arm for accommodating adjustment of the movement arm to align the centerlines of the torso mass and the counterweight assembly as described above. Received through the slot 105 and the opposite sides 95 of the screw frame is a longitudinally reciprocable actuating shaft for applying pressure, through a thrust tube 106 telescoped thereon, on clamp washers 107 positioned on opposite sides of pressure plate 104 for clamping the pressure plate therebetween when the shaft is moved in one direction and for releasing the pressure plate from the clamp washers 107 when the shaft is moved in the opposite direction. The actuating shaft is actuated to the aforesaid positions by a hand lever 109 having a block cam 110 pivoted to the shaft to engage the thrust tube 106 to press the washers on the pressure plate 104 when the lever is moved into the position shown in FIG. 2 and to release the washers 107 when the lever 109 is moved to a horizontal position.

RESISTANCE WEIGHT FOR LOADING THE MOVEMENT ARM

During the exercise mode of the machine, the movement arm is loaded with a yieldable resistance preferably in the form of one or more dead weights which are lifted upon extension of the spine producing rearward movement of the movement arm and lowered upon return of the spine to the starting position, wherein the spine is bent forward and has moved up to about 72° (degrees) from the position of full extension. Lifting of the weights through forces exerted by the lumbar muscles is positive work and lowering of the weights is negative work. As will be described further below, the magnitude or force of the resistance weights selected in any given exercise according to the method of the present invention is safely less than the maximum strength of the lumbar muscles as initially determined through a static strength test to be described.

Shown in FIG. 1 is a compound weight stack preferably employed to provide the resistance weight for exercise with the machine. The weight stack includes two independent groups of weights 115 and 116 with the weights of one group being substantially less in magnitude than that of the other group to thus enable precise weight selection suitable to the strength of a particular exerciser. Once or more weights of each group may be connected to a cable or chain 117 to furnish the desired yieldable resistance to movement of the movement arm. A more detailed description of the compound weight stack may be gained by reference to my prior copending U.S. application Ser. No. 07/181,372 identified above and incorporated by reference into the disclosure of the present application as part hereof.

DRIVE TRANSMISSION BETWEEN RESISTANCE WEIGHT AND MOVEMENT ARM

Figure 8:
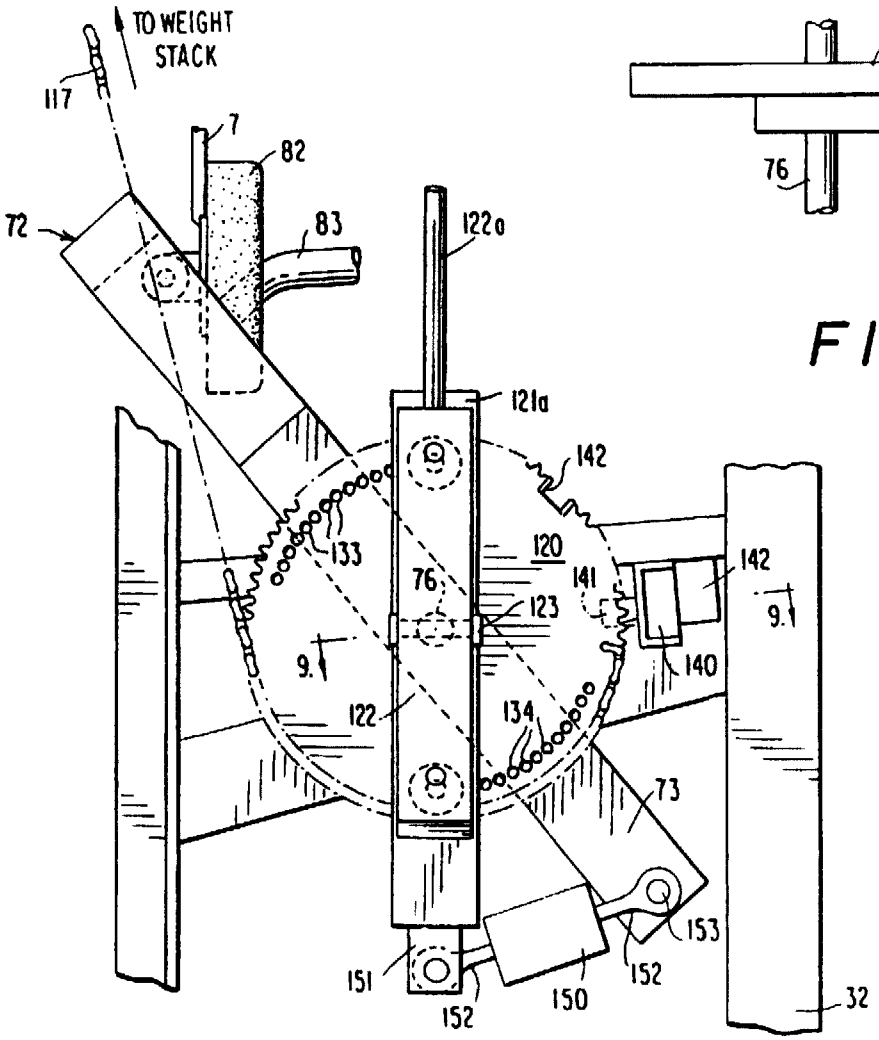
FIG. 8 is a side view of FIG. 7.

The resistance weights are connectable and disconnectable to the movement arm by means of an appropriate transmission system which in the preferred embodiment includes a sprocket and toggle assembly mounted on the pivot shaft 76 of the movement arm. Referring to FIGS. 2, 7 and 8, this assembly includes a sprocket 120 rotatably mounted about the pivot shaft 76 of the movement arm 72. The chain 117 from the resistance weight stack is trained about the sprocket 120.

In order to drivingly connect the sprocket 120 to the movement arm 72 to drive the sprocket to lift the resistance weights, a toggle assembly is provided including a pair of keeper plates 121, **121*a* mounted for rotation about the shaft 76 on opposite sides of the sprocket 120. Connected between the top and bottom of keeper plates 121 and 121*a* are spacers 119**.

In the preferred embodiment shown, the movement arm 72 is connected to the spacer 119 of the keeper plates so that when the keeper plates are connected to the sprocket 120 as will be described below, a drive will be established between the movement arm 72 and the resistance weight stack. The toggle assembly further includes a toggle lever 122 having an intermediate portion thereof connected such as by pivot pin 123 to the outer end of shaft 76 so that the toggle lever 122 is rotatable with shaft 76 while being pivotable in the longitudinal direction of the shaft 76. Provided on opposite end portions of the toggle lever 122 are a pair of toggle pins or latch pins 124 and 125 to be engaged in the sprocket 120 for establishing a drive connection between the sprocket 120 and the movement arm 72. In the specific embodiment shown, toggle pins 124 and 125 are connected by small links 126 and 127 to the toggle lever 122; the links 126,127 being pivotably connected to the toggle pins and toggle lever. Toggle pins 124 and 125 are slidably mounted in bushings 128 and 129 fixed in opposite end portions of keeper plate **121*a*. The other keeper plate 121 has upper and lower apertures, 130, 131 in alignment with and to receive the toggle pins 124, 125 respectively when either of the pins is extended to engage the sprocket 120**.

As shown in FIG. 8, sprocket 20 is provided with an upper and lower set of angularly spaced apertures 133, 134 for receiving toggle pins 124 and 125 respectively. Each of the apertures 133 and 134 provides a different angular setting between the toggle lever 122, pivot shaft 76, movement arm 72 and the sprocket 120, it being understood that the movement arm 72 rotates together with the pivot shaft 76 and toggle lever 122. In order to select any of the angular settings of the upper apertures 133, the toggle lever 12 is pivoted counterclockwise as viewed in FIG. 7 to a neutral position shown in FIG. 2 where both toggle pins 124 and 125 are retracted from any aperture in the sprocket 120. The lever 122 is then rotated in a plane perpendicular to the axis of shaft 76 to rotate the shaft 76 and the movement arm 72 until the desired angular setting is reached, and then the toggle lever 122 is rotated clockwise as viewed in FIG. 7 to extend the upper toggle pin 124 through the selected aperture 133 and the aperture 130 in the keeper plate 121 as shown in FIG. 7. If another angular setting corresponding to one of the lower apertures 134 is desired, the toggle lever 122 must, of course, be rotated counterclockwise as viewed in FIG. 7 to withdraw the upper toggle pin 124 from the upper aperture 133, then the toggle lever must be rotated to the new angular setting and then the toggle lever must be pivoted counterclockwise to insert the lower toggle pin 125 in the selected aperture 134 and the aperture 131 of the keeper plate 121. A handle **122*a* is provided on the toggle lever to facilitate handling thereof. In the preferred embodiment shown, a total of twenty-three apertures 133 and 134 are provided in the sprocket 120** thus permitting twenty-three different angular positions of the movement arm for testing static strength of the lumbar muscles.

It will, of course, be understood that once the sprocket chain 117 is connected to the resistance weights, and one of the toggle pins 124 or 125 is engaged in the sprocket 120, the movement arm will be ready for an exercise during which rotation of the movement arm 72 counterclockwise as viewed in FIG. 8 will lift the weights as the sprocket 120 will be drivingly connected to the pivot shaft 76 of the movement arm by the toggle assembly. The different angular settings provided by apertures 133 and 134 will also allow the range of angular movement of the exercise to be adjusted to suit a particular person in an exercise. If desired, limit stops (not shown) may be provided between the sprocket 120 and the adjacent stationary frame portions to limit the opposite rotative positions of the sprocket.

STATIC STRENGTH TEST APPARATUS

Figure 9:
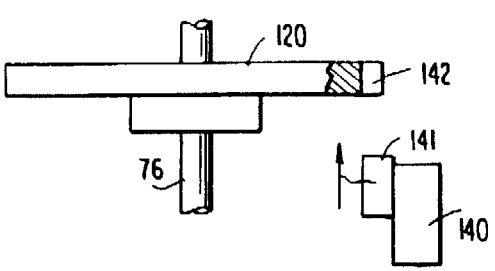
FIG. 9 is a schematic cross-sectional view taken generally along lines 9—9 of FIG. 8.

The different angular settings of the movement arm 72 as determined by the apertures 133 and 134 is also used to test the static strength of the lumbar muscles in each of the different angular positions of the spine as will be determined by the angular set of the movement arm. In order to effect this test, it is necessary to fix the movement arm against movement in the angular position selected. In the preferred embodiment shown, this is accomplished by locking the sprocket 120 by any suitable means such as by a lock bar 140 having a lug 141 receivable in an aperture 142 formed in the periphery of sprocket 120 as shown in FIGS. 8 and 9. Lock bar 140 is slidably mounted to a stationary frame member 142 to be slid by hand inwardly to engage in the sprocket recess 142 or outwardly to disengage from the recess 142. Since in selecting the angular orientation of the movement arm 72 for the test, one of the toggle pins 124 or 125 has been inserted in one of the apertures 133 or 134 of the sprocket 120, the pivot shaft 76 of the movement arm will also be locked against movement to thereby prevent rotation of the movement arm when the person being tested exerts a force on the movement arm for purposes of testing the static strength of the lumbar muscles.

Referring to FIGS. 7 and 8, in order to measure the static strength of the lumbar muscles, the preferred embodiment of the machine utilizes a strain gauge 150 connected between the lower end portions of the movement arm 72 and the spacer 119 of the keeper plates 121, 125*a* by eye bolts 152 received about pins 153 fixed on the movement arm and a strap 151 depending from spacer 119. The static strength of the lumbar muscles is measured at different angular orientations of the movement arm since the static strength will vary depending on the angular orientation of the spine. In this way, an accurate measure of strength is obtained over a range of spine positions so as to correlate strength with angular position of the spine.

METHODS OF TESTING AND EXERCISE

As described above, the machine of the invention described above is capable of measuring static strength of the lumbar muscles when the movement arm 72 is locked stationary. In addition, the machine is capable of measuring the work capacity of the lumbar muscles when the movement arm 72 is free to rotate against the load of the resistance weight. The latter mode is also employed to exercise the lumbar muscles to strengthen or rehabilitate them.

Before testing for work capacity, the static strength of the fresh lumbar muscles is first determined over a range of different angular positions of the spine between the bent forward position and fully extended position. A graph of the static strength is produced and recorded through a computer and displayed on a video screen as the test proceeds. Once the static strength is determined, then the resistance weight is selected for the work capacity test to be less, as much as 30% (percent) or more than the maximum static strength so that there will be no chance of injuring the lumbar muscles during the work capacity test.

In the work capacity test, the subject is asked to pivot the weighted movement arm 72 rearwardly to perform "positive work" and forwardly to perform "negative work" and to repeat the process over a predetermined range of movement until the lumbar muscles fatigue and can no longer produce positive work. A graph of the work capacity test is produced and recorded through the use of a computer, the graph measuring the work capacity in terms of pound seconds over a predetermined range of movement. Immediately following the work capacity test, the static strength of the subject is again measured over the same range of angular positions and a graph of this test is recorded so that the effect of the work capacity test on the lumbar muscles may be determined from a comparison of the graphs. This comparison may be used to determine the fiber-type of the lumbar muscles and their response to, and tolerance for, exercise. It may also be used to determine a specific injury or weakness existing in the lumbar muscles and how such muscles may be rehabilitated. Moreover, once the relationship between static strength and work capacity is determined for a specific individual, in subsequent tests, static strength can be determined by measuring work capacity alone or work capacity can be determined by measuring static strength alone for the same individual. The reason this may be done is that when any given percentage of your existing level of strength is provided as resistance in a test of anaerobic endurance, then the resulting number of repetitions will always be the same, at any level of strength providing only that the style of performance is always a constant.

Thus . . . if, at an existing strength of 100, you can perform ten repetitions with 80, then if your strength is raised or lowered, to any degree, you will always perform only ten repetitions with eighty percent of the new level of strength. For example, strength 100 means ten repetitions with 80 or eighty percent. Thus strength 200 means ten repetitions with 160. Still eighty percent and strength 300 means ten repetitions with 240. Always eighty percent.

That exact ratio exists for some people, but not all people . . . a few can do only one repetition with eighty percent, and others can do forty repetitions with eighty percent. This relationship never changes except in cases of injury, and then returns to normal when rehabilitation is complete . . . but the individual ratio between these two factors, strength and endurance, must be established in each subject. Once this ratio is known in any individual case, then you can determine strength by measuring endurance, or can determine endurance by measuring strength.

SUMMARY OF OPERATION AND METHODS

To summarize operation of the machine in accordance with preferred methods of the invention, the subject is seated on seat 16 with his pelvis against pelvic pad 17 and his calves against calf support pad 35. Thigh straps 20, 21 are buckled over the thighs, and the hand wheel 34 is turned to sufficiently tension thigh straps 20, 21 to prevent upward movement of the thighs. The shin pads 54 are then extended against the legs by turning hand wheel 70 until the shin pads 54 rotate the femurs about the thigh strap 20, 21 to anchor the pelvis downwardly and rearwardly against the pelvic pad 17. The subject is then asked to bend his spine forwardly and rearwardly to see if any unwanted pelvic movement occurs causing the pelvic pad 17 to move as will be detected by the goniometer 19. If movement occurs, the shin pads 54 are extended a bit further until no movement of the pelvis occurs.

With the use of the toggle lever 122, both toggle pins 124 and 125 are removed from the sprocket 120 to free the movement arm 72 for rotation. The subject and the movement arm 72 are then moved into the dead center position with the head and arms fixed in position as determined by the head and arm rests. Lever 109 is then pivoted to actuate clamp washers 107 against the pressure plate 104 to connect the counterweight assembly including counterweights 100 to the movement arm. The subject is moved to the rear position and the torque of the torso mass is read from the digital register associated with the counterweight assembly. Hand wheel 102 is then rotated to raise or lower the counterweights 100 until the torso mass is balanced about the pivot shaft 77 as will be indicated when the digital register reads zero.

The lock bar 140 is moved inwardly to engage the lug 141 in the aperture 142 of the sprocket 120 to lock the sprocket 120 against movement. The several angular positions for each test are selected and the toggle lever 122 is manipulated to lock the movement arm at each position. At each position, the person is asked to rest against the resistance pad 82 and a reading from the goniometer 88 associated with the resistance pad 82 is taken at each position. This reading is then introduced into the computer along with each of the angular positions to enable the computer to determine an accurate measure of strength at each position. The subject is now ready to start the actual strength test.

The movement arm 72 is rotated to the first position for the static strength test and the toggle lever 122 is then pivoted to insert one of the toggle pins 124 or 125 into one of the apertures 133 or 139 corresponding to the desired position.

The subject then grasps the arm supports 83 and positions his head against the head pad 6 to thus fix the positions of the head and arms relative to the movement arm 72. With his back already resting against the resistance pad 82 to avoid impact forces, the subject is then asked to exert slowly and gradually as much force as possible with his lumbar muscles to transmit a force through the resistance pad 82 to the movement arm. When the subject reaches the highest lever of force, he should relax until no force is produced on the resistance pad. The force applied is reflected in the strain gauge 150 whose reading is fed into the computer to calculate the actual strength applied by the lumbar muscles. A graph of this strength is produced and recorded. The toggle lever 122 is then manipulated to retract the toggle pin and move the movement arm to the next test position at which time a toggle pin is inserted in the corresponding aperture 133 or. 134 and the strength test is repeated for this position. The process is repeated for each of the selected positions and the recorded graph will reflect the maximum strengths at each of these positions by a line interconnecting the maximum strengths at each position.

When a subject is being tested for the first time, the work capacity test should immediately follow the static strength test of the fresh lumbar muscles. Additionally, immediately following the work capacity test, the subject is again tested for static strength to determine the effect of the work capacity test on the lumbar muscles.

In conducting the work capacity test, it is important thta the resistance weight selected be safely less than the maximum static strength of the lumbar muscles. Having already conducted the static strength test of the fresh lumbar muscles, a safe resistance weight may be accurately selected using the compound weight stack of the present invention. For example, if the maximum static strength of the subject's lumbar muscles is 100, a resistance weight of 70 may be selected for the work capacity test.

In conducting the work capacity test, the subject is still held in the seat with his pelvis restrained against movement. The appropriate resistance weights are connected to the sprocket chain 117. The lock bar 140 is then retracted from the sprocket 120 to free the sprocket for rotation by the movement arm. The toggle lever is then operated to place one of the toggle pins 124, 125 into the appropriate aperture 133 or 134 of the sprocket to determine the range of movement of the movement arm in accordance with the capability of the subject as well as to establish the drive betwen the movement arm 72 and the sprocket 120. With his head and arms maintained in fixed positions as determined by the head and arm supports the subject is bent forward to a position of a bit less than 72° (degrees); meaning that they are bent forward by that number of degres from a position of full lumbar-extension . . . some subjects can bend more, some less, but a safe starting position should be used in all cases, a pain-free position. In that position, at the start of the test, the subject is instructed to start producing force . . . very gradually, in the smoothest manner possible, avoiding any sudden muscular contractions or jerky movements.

The test of work-capacity is now underway . . . having been started in the safest possible manner. Since the level of force was increased very slowly, the subject had plenty of time to reduce these forces at the first sign of pain or discomfort; forces that might cause an injury were thus avoided.

As the movement proceeds to the left across the chart, the computer will draw a thin line which displays the exact level of force in every position . . . even though the actual level of force steadily drops off as movement occurs, must drop off since you are weaker in the more extended positions, drops off as a consequence of the cam associated with the sprocket chain of the resistance weight that varies the resistance throughout the movement, changes the level of resistance as you change position, always keeping an appropriate level of resistance in every position.

When the subject has moved as far back as they can in a safe manner, then the subject should pause in that rear position for a very brief period, for a second or less . . . which pause is required to assure that he can pause and hold that position; because, if he cannot pause and hold against the level of resistance in that position, then he did not move into that position by muscular contraction in the first place . . . instead, coasted into that position as a result of kinetic energy which resulted form too fast a speed of movement.

After a brief pause in the rear position, the subject leaves the positin of full lumbar-extension and moves back towards the position where he started. This will produce a second thin line across the chart, now moving from left to right . . . as he performs the negative part of the first repetition, the force now increasing back towards its highest point as he moves towards his strongest position.

When the subject has moved forwards to the limit of safe movement, he must not relax and reduce the level of force . . . instead, immediately but smoothly he must start moving back to the rear as he starts the second repetition . . . now performing the positive part, the lifting part, of the second repetition. And so on . . . always moving slowly and smoothly, except for the very brief pauses in the rear position at the completion of the positive part of each repetition.

Continue in that fashion until continued movement is impossible . . . which will occur when the level of his positive strength drops even slightly below the level of resistance; and, in such a totally isolated test of lumbar function, he will fail before he expects to . . . he will be moving along in what feels like a rather easy manner, probably convinced that he can perform at least several more repetitions, and then with little or no advanced notice from his muscles that they are so fatigued, he will find continued movement impossible. It may surprise you the first time you take such a test.

The unexpected failure occurs because you cannot bring into play the strength of any other muscles in order to help the lumbar muscles continue . . . when the lumbar muscles become too fatigued to produce a force equal to the resistance then you must stop.

That concludes the test . . . do not attempt to continue the movement by jerking, you may be able to continue for one or two more repetitions by jerking and thus stimulating the pre-stretch reflex . . . but doing so unavoidably creates levels of force that are not safe enough for test purposes, and that are not required for test purposes in any case.

When positive movement becomes impossible, pause briefly in the position where you failed, then slowly bend forwards to the starting position and upon reaching the starting position gradually reduce the level of muscular force to zero. The test is finished, the computer has all the information it needs to calculate your work-capacity . . . and you have provided that information in the safest possible manner, never exposing yourself to high and perhaps dangerous levels of force at any time during the test. The results of the work capacity tests are recorded on a graph for comparison with future work capacity tests. Following the work capacity test, a subject (being tested for the first time) is again tested for static strength to compare the results with the first static test of the muscles which comparison gives highly useful information.

Once the relationship between static strength and work capacity for a particular individual is determined, it is only necessary to conduct work capacity tests in the future in order to determine that individual's static strength. Work capacity tests are preferable to static strength tests since the subject is safely moving a force less than the subject's maximum strength.

The work capacity mode of the machine may also be used to simply exercise the lumbar muscles in order to strengthen, condition or rehabilitate them. Once a subject has been tested and graphs of the test produced, a safe and effective exercise or rehabilitative program may be designed for a particular subject.

Although the invention has been shown and described with reference to application to the lumbar muscles, methods and apparatus in accordance with the invention may be applied to exercise and test the abdominal muscles as well as other muscles of the human body without departing from the scope of the invention which is indicated in the appended claims.

BICEPS CURL MACHINE

Figure 10:
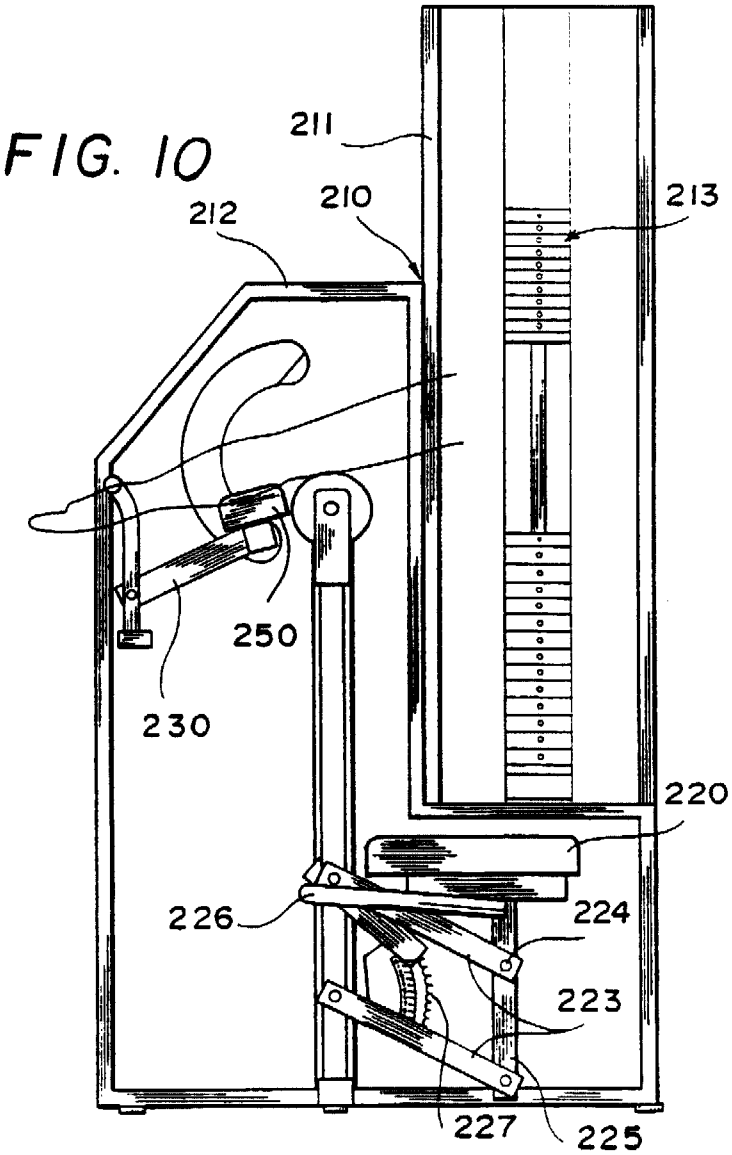
FIG. 10 is a side elevational view of a preferred biceps curl machine embodying the invention and shown with certain parts removed for clarity.
Figure 11:
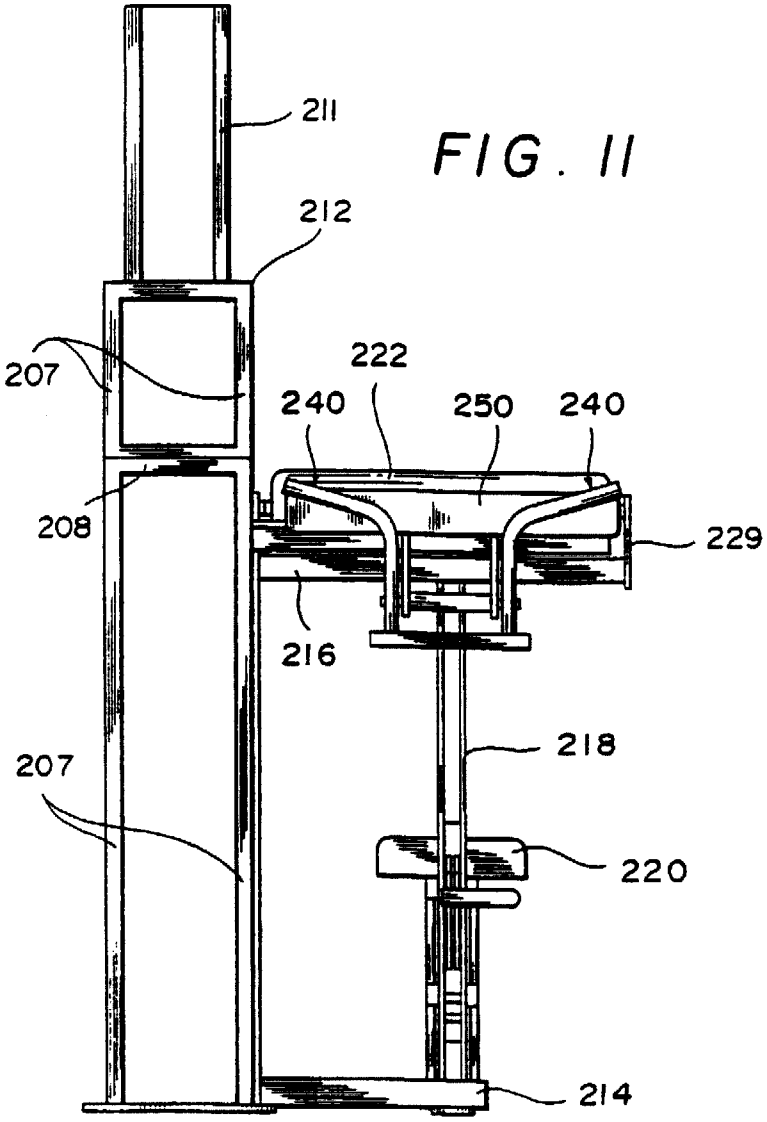
FIG. 11 is a front elevational view of the machine shown in FIG. 10.
Figure 12:
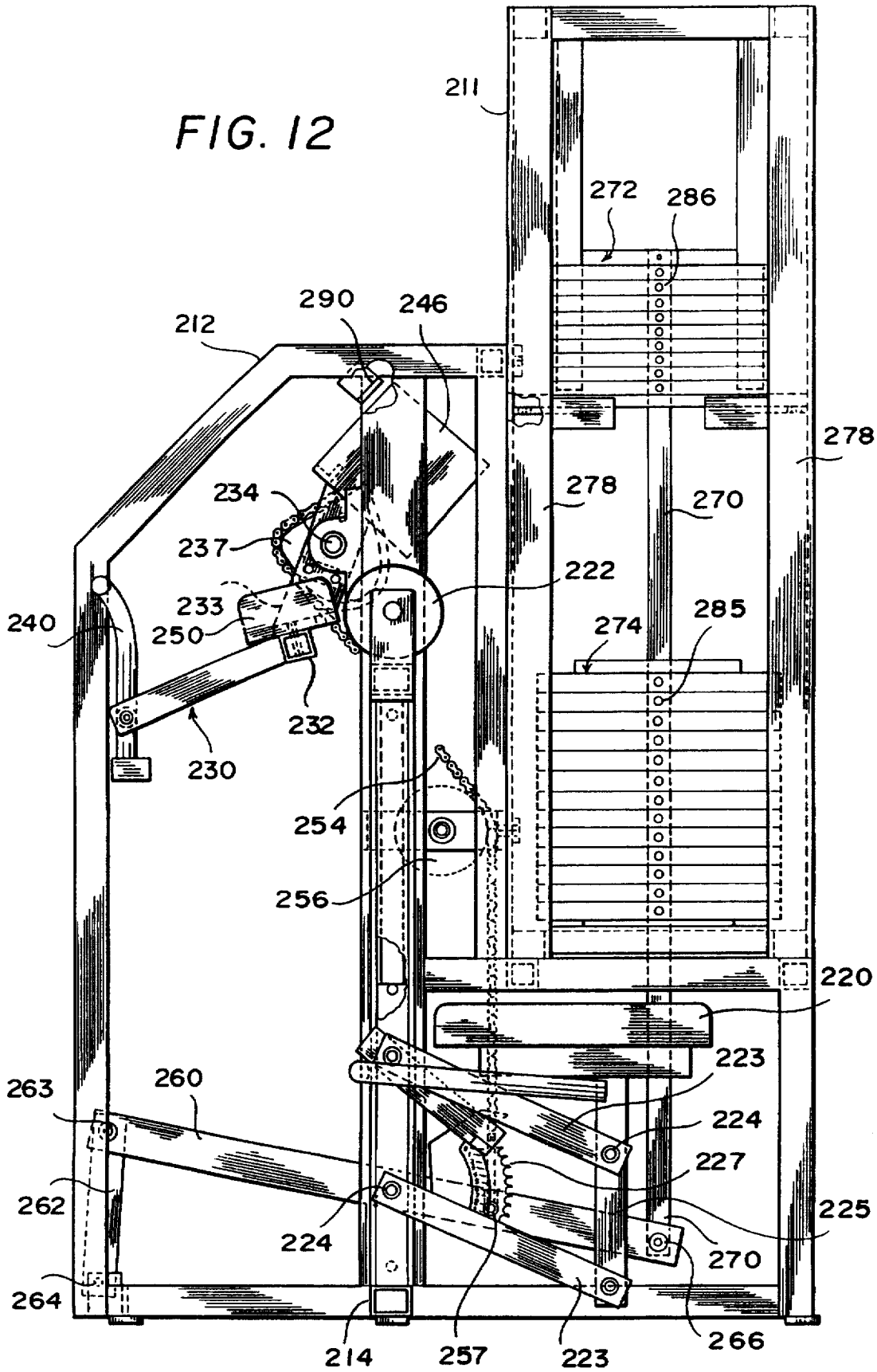
FIG. 12 is an enlarged side elevational view of the machine as seen in FIG. 10 but additionally including various parts of the drive system which interconnects a movement arm and a weight stack which provides resistance to the movement arm.
Figure 13:
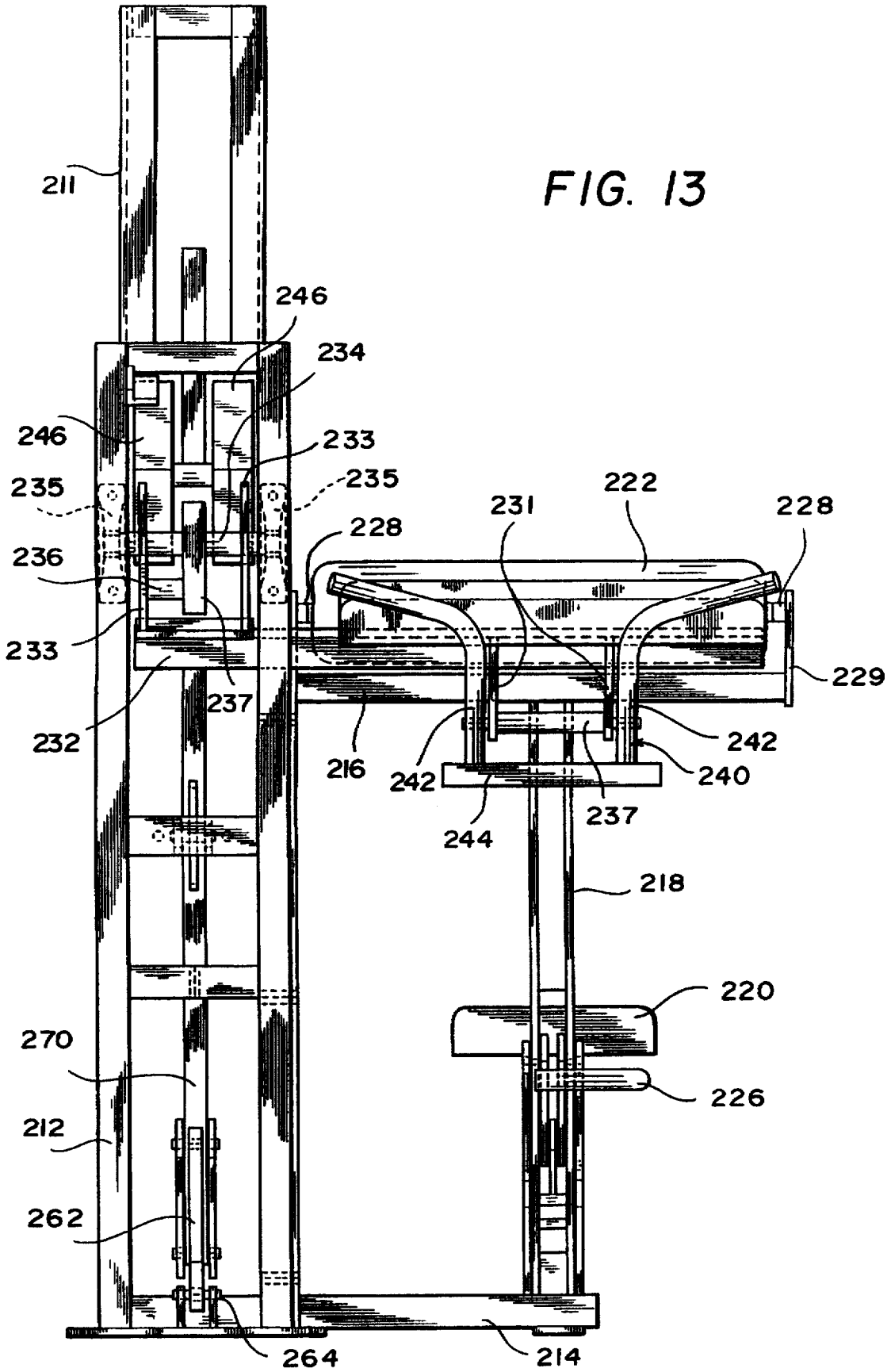
FIG. 13 is an enlarged elevational view generally similar to FIG. 11 but showing additional parts.

Referring now to FIGS. 10 through 18 of the drawings in detail and initially to FIGS. 10, 11 and 12, there is shown for illustrative purposes only, an arm biceps curl machine embodying the present invention and including a main frame generally designated 210 composed of vertical columns 207 joined by horizontal crosspieces 208 to form a generally rectangular frame structure, the members thereof being formed from structural steel or any other suitable material of sufficient strength. Main frame 210 includes a section 211 which houses a weight stack generally designated 213. In addition, main frame 210 includes a section 212 positioned forwardly of section 211 for housing a drive system by which movement of a movement arm generally designated 230 raises one or more weights of the weight stack which serve as resistance opposing movement of the movement arm in the clockwise direction as viewed in FIG. 10. As shown in FIGS. 11 and 13, a subsidiary frame structure projects laterally from the frame 212 for purposes of supporting a horizontal seat 220 and arm support pad 222 as will be described below. The subsidiary frame includes a base 214 projecting from the foot of frame section 212, mid-height horizontal frame 216 fixed to and projecting laterally from frame 212, and a vertical frame member generally designated 218 interconnecting the subsidiary frame members 214 and 216. Seat 220 is mounted for vertical movement to adjust the level to suit the user by means of a linkage mechanism including parallel links 223 pivoted by pivots 224 at one end to the support member 225 fixed to the bottom of seat 220. In the preferred embodiment a pair of parallel links 223 are provided on opposite sides of the frame 218 for purposes of adjusting the elevation of seat 220 when actuated through any suitable handle shown at 226. Any suitable releasable latch mechanism generally designated 227 is provided for releasably holding the linkage mechanism 223 and in turn the seat 220 in a desired adjusted position.

Supported on a subsidiary frame member 216 to extend laterally of the main frame sections 211 and 212 is a pad for supporting the upper arm portions of the user as best shown in FIG. 10. The preferred embodiment of this pad is a roller pad 222 having shafts 228 in the opposite ends thereof mounted in plates 229 fixed to frame member 216 as best shown in FIG. 13. Roller pad 222 is rotatable relative to the frame 216.

Figure 14:
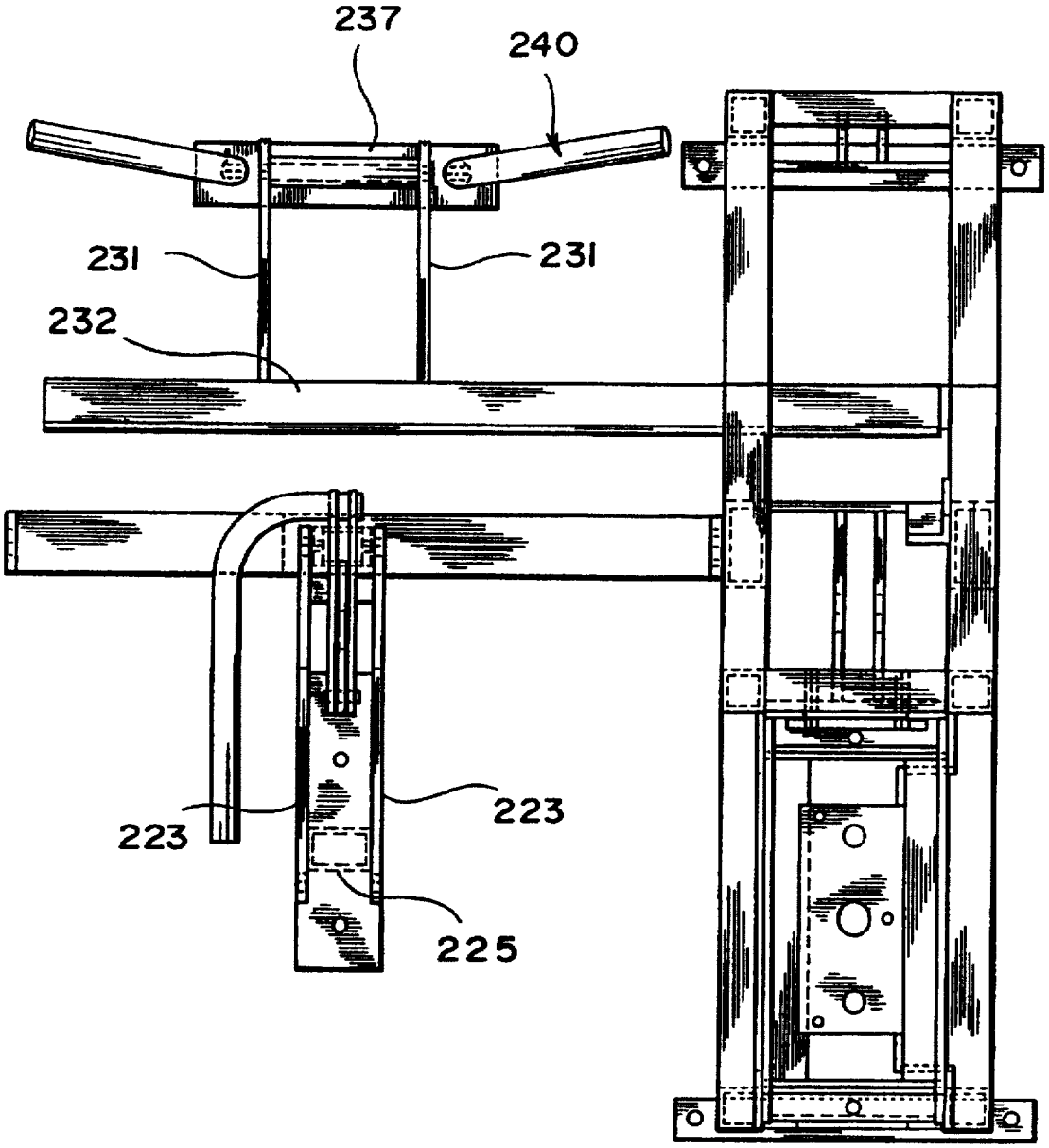
FIG. 14 is a plan view of the machine with certain parts removed for clarity.

Referring to FIGS. 13 and 14, movement arm 230 includes in the preferred embodiment an elongated beam 232 mounted for movement about a shaft 234 (FIG. 13) by means of a yoke fixed to the beam 232 and having arms 233 rotatably mounted on shaft 234. The latter in turn is mounted on frame 212 by bearings 235. For rotating the movement arm about shaft 234, a hand grip 240 is connected to the movement arm beam 232 by means of connecting members 231 fixed to beam 232 at one end and pivotally connected to the hand grip 240 at the other end by means including a cross piece 237. In the preferred embodiment hand grip 240 includes opposed inverted L-shaped members as seen in FIG. 13 interconnected at their lower end by a crosspiece 244 and pivotally connected intermediate their ends to members 231 as described above. Hand grip 240 is adjustable relative to movement cam 230 to suit the size of the user's forearms. Crosspiece 240 is suitably weighted to balance the hand grip 240.

Figure 15:
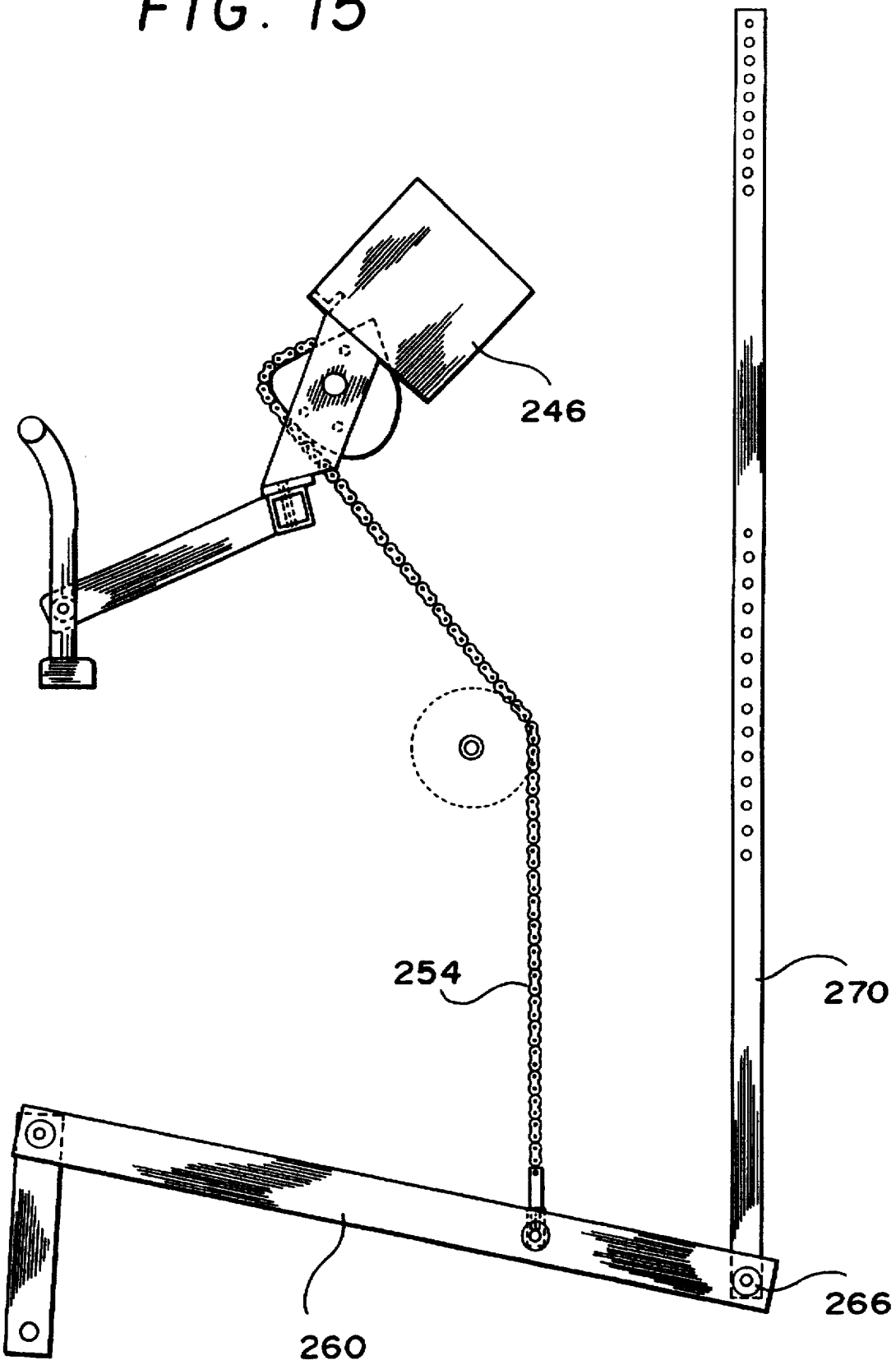
FIG. 15 is a side elevational view of the movement arm and drive system when the movement arm is at a start position.
Figure 16:
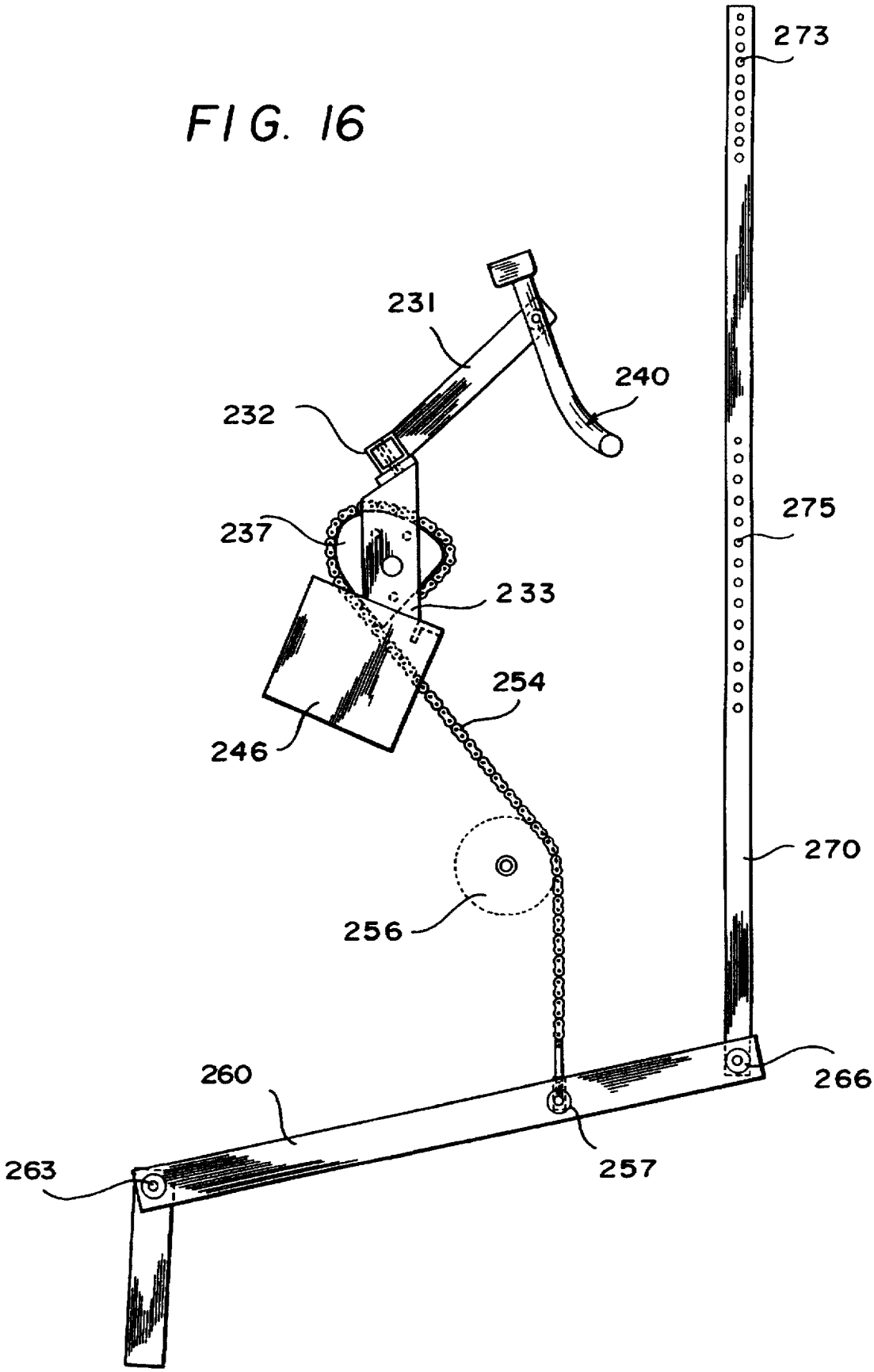
FIG. 16 is a view generally similar to FIG. 15 but showing the parts when the movement arm is at a finish position.

Rotation of movement arm 230 about movement arm shaft 234 is transmitted by a connecting member 236 to a cam 237 mounted for rotation about shaft 234 as shown in FIGS. 12 and 13. Cam 237 is connected to the resistance weight which imposes a force in opposition to rotation of the movement arm 230 about shaft 234 in a clockwise direction as shown in FIGS. 12, 15 and 16. In the preferred embodiment this connection is through means of a chain 254 fixed at one end to the periphery of the cam 237 and trained for a portion of its length around cam 237. In addition and as seen in FIG. 12 chain 254 is trained about an idler pulley 256 supported in arms fixed to frame portion 218. At its lower end, chain 254 is pivoted at 257 to an intermediate portion of a drive lever 260 the forward end of which is pivoted at 263 to a vertical link 262 whose bottom end is pivoted at 264 to the base of frame 212. The opposite end of drive lever 260 is pivotally connected by pivot 266 to the lower end of a weight stack rod or pin generally designated 270 extending vertically in frame section 211. When the movement arm is pivoted clockwise from the position shown in FIG. 15 to that of FIG. 16, the chain 254 lifts lever 260 about pivot 263 causing rod 270 to lift one or more reistance weights. In the preferred embodiment a compound weight stack such as shown in my U.S. Pat. No. 4,834,365 is employed including an upper stack 272 and a lower stack 274 of individual weights in the form of plates guided in vertical movement by frame members 278 shown in FIG. 12. One or more of the weights in stacks 272 and/or 274 may be connected to pin 270 by inserting a pin through apertures 285 or 286 in the weight plates and in apertures 275 and 273 (FIG. 16) in the weight stack rod 270. As will be understood, one or more weights of either stack 272 or 274 may be connected to the pin 270. Also if desired, one or more weight plates of only one of these stacks 272 or 274 may be connected to pin 270. In one embodiment, the weight plates of the upper stack 272 may be each two pounds thus allowing weight changes in two pound increments. Of course any other suitable weight plates may be chosen for the upper or lower stacks 272 and 274. Because of the orientation of the weight stack relative to the seat 220, the user may change the resistance weight while seated on seat 220.

Figure 18:
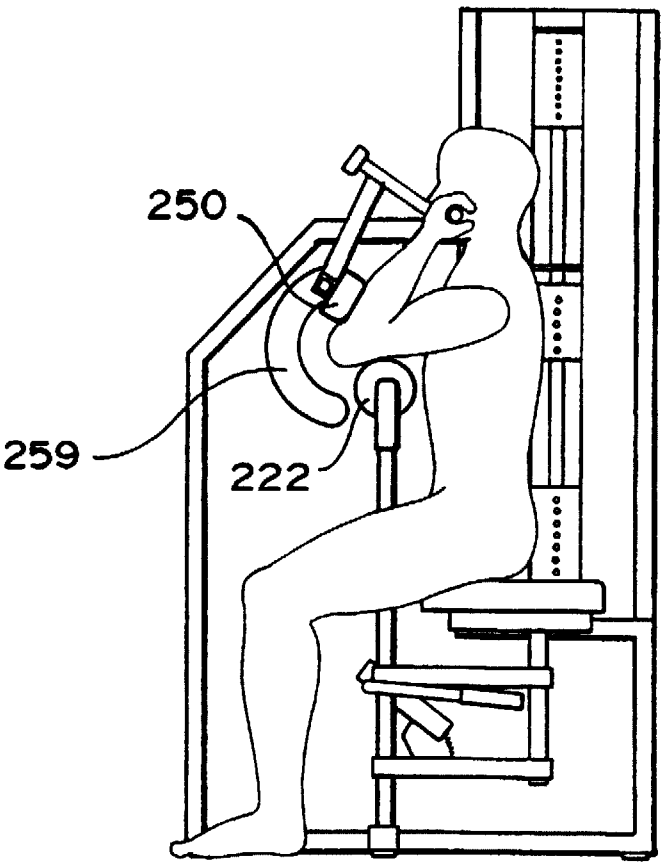
FIGS. 17 and 18 are schematic views showing a user of the machine at start and finish positions corresponding to FIGS. 15 and 16.
Figure 17:
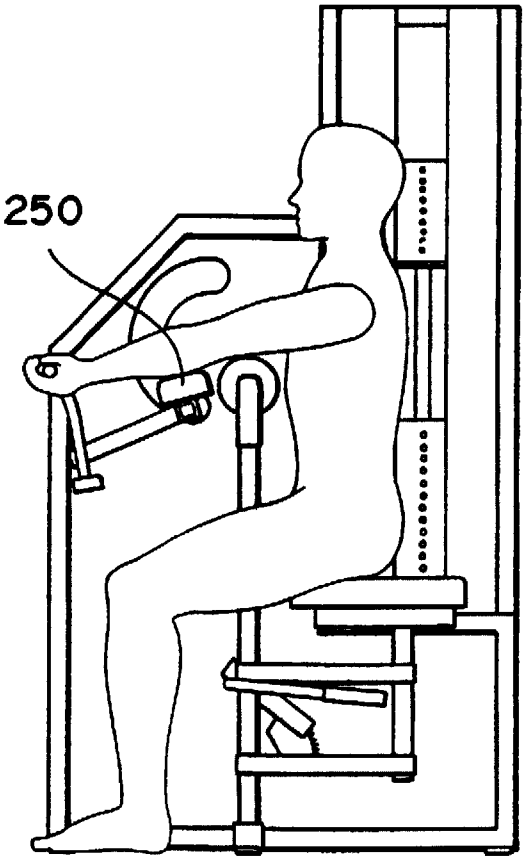

In use of the machine, the user sits on seat 220 with his legs straddling the vertical frame 218. In the starting position shown in FIGS. 10 and 17, the user extends his arms so that the backs of the upper arm portions rest on the roller pad 222 and so that the hands are free to grip the hand grip 240 of the movement arm. Assuming the position of seat 220 and the desired weight resistance has been selected, the user pivots his forearms about the elbow while rotating the movement arm about the movement arm shaft 234 which of course requires that the biceps be flexed. In order to prevent the user's torso from moving forwardly relative to the seat 220 as he performs the exercise, a forearm pad generally designated 250 is provided on the movement arm to extend along the beam 232 as best shown in FIGS. 12 and 13. Pad 250 is fixed to the beam 232 to be rotatable therewith along the arc 259 (FIG. 18) and about the pivot axis 34 of the movement arm. In this way the forearm pad 250 moves forwardly and upwardly in rotation about the movement arm shaft 234 with the backs of the forearms pressed against the pad 250 as the user exerts his bicep muscles to lift the resistance weights. Note from FIG. 18 how the user is constrained by pads 250 and 222. Moreover because of the rotation of pad 250 as the user bends his elbow and lifts the resistance weight, the position of the elbow is allowed to self-adjust to generally align itself with the pivot axis 234 of the movement arm thus achieving efficient operation. FIGS. 17 and 18 illustrate the positions of the forearm pad at the beginning and end of the weightlifting stroke. At the end of the stroke the resistance weight is lowered by extending the forearms to the start position of FIG. 17. The exercise is then repeated as desired.

In the preferred embodiment the movement arm 230 is balanced about the shaft 234 by means of counterweights 246 respectively fixed to members 233 as shown in FIGS. 12 and 13. If desired a stop 290 may be provided in frame 212 to engage counterweight 246 to limit its movement.

TORSO-ARM MACHINE

Figure 19:
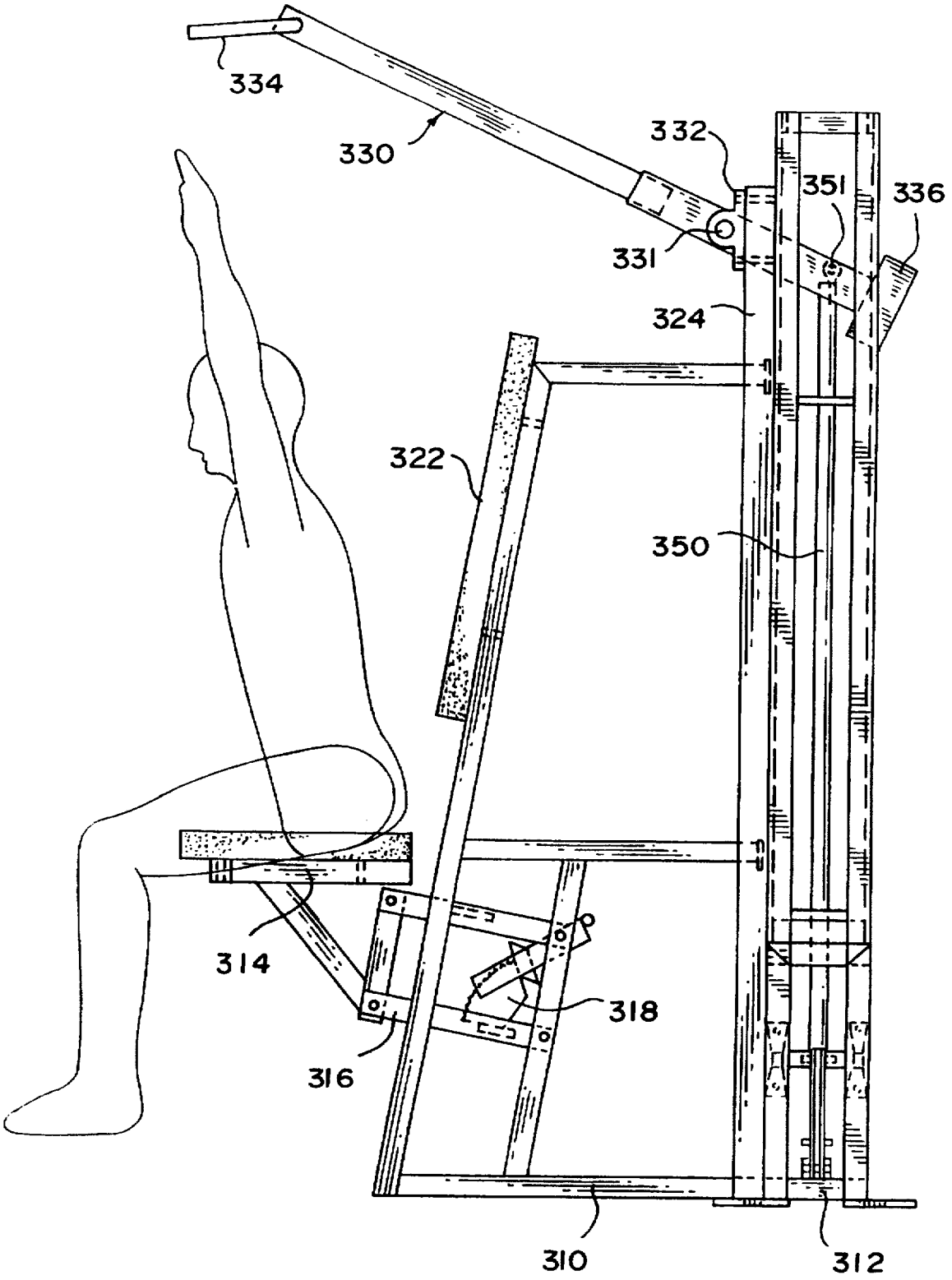
FIG. 19 is an elevational view of a torso arm machine embodying the present invention as seen from one end thereof.
Figure 20:
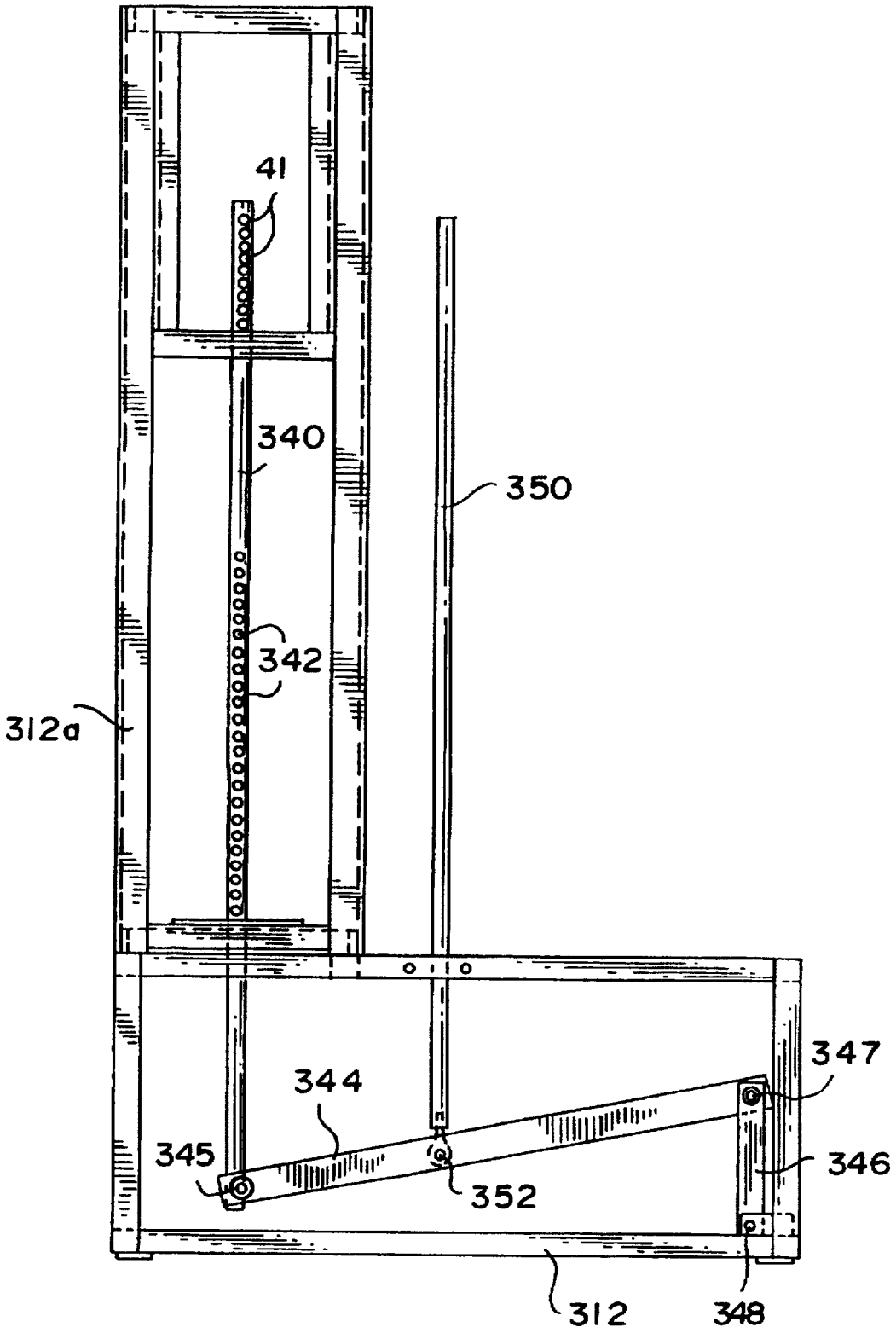
FIG. 20 is a front elevational view of the machine shown in FIG. 19 but with portions removed.
Figure 21:
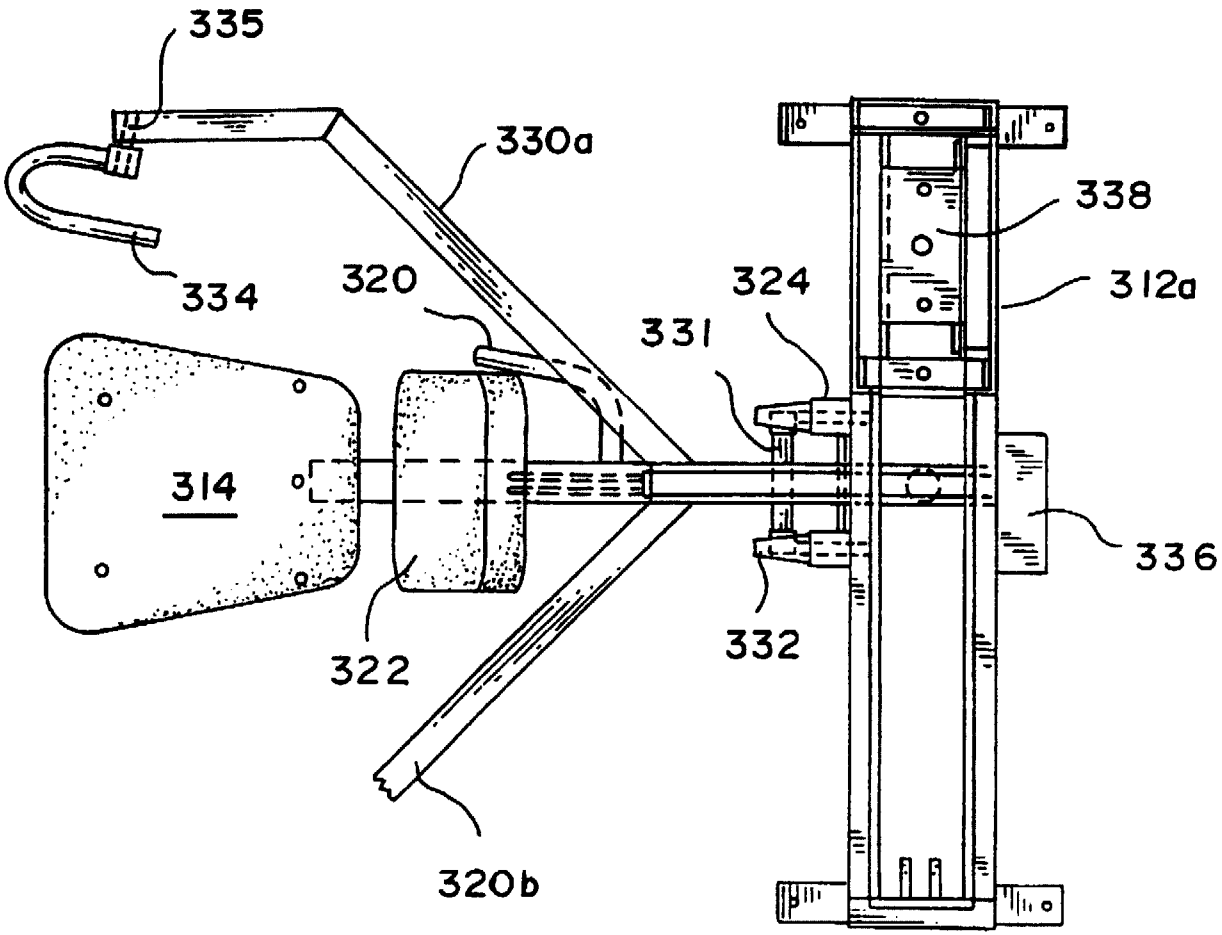
FIG. 21 is a plan view of the machine shown in FIG. 19.

Referring now to the drawings in detail, there is shown for illustrative purposes only in FIGS. 19 through 23, another machine embodying the present invention and which may be termed a "torso arm" machine for exercising muscles of the upper chest, back, arms and shoulders. In the preferred embodiment shown, the machine includes a front frame generally designated 310 and a rear frame generally designated 312 which are made from elongated rails or tubular stock of high strength metallic material, however any other suitable material may be utilized as long as it provides the necessary strength and weight. Front frame 310 includes a seat generally designated 314 mounted to the frame by means of a parallelogram linkage generally designated 316. Linkage 316 is adjustable vertically to change the elevation of the seat 314 to suit the user and once adjusted it is held in place by a latch plate 318 receiving a latch pin which is actuated by means of a handle 320 shown in FIG. 21. Front frame 310 further includes a backrest 322 fixed to upper portions of the front frame as best shown in FIGS. 19 and 21.

To exercise the muscles, the user sits on seat 314 as shown in FIG. 19 and with his arms grasps a movement arm generally designated 330 and lowers the movement arm 330 by pivoting it about a generally horizontal axis shown at 331 in FIG. 19. In the preferred embodiment shown, the movement arm is a yoke arm having arm portions 330*a* and 330*b* converging to a rectilinear portion which is mounted about a pivot shaft 331 which in turn is mounted in bearing blocks 332 fixed to a vertical frame portion 324. The extremities of yoke arms 330*a* and 330*b* are provided with handlebars 334 preferably pivotably mounted about pivot pins 335 to the yoke arms 330*a* and 330*b* as best shown in FIG. 21. Handlebars 334 are thus adjustable about the pivot pins 335 to suit the needs of the user. Movement arm 330 is mounted on the front side of the frame 312, 324 and extends rearwardly of the pivot shaft 331 where it terminates in a counterweight 336 which balances the movement arm relative to its pivotal axis 331.

In accordance with the present invention, a novel drive system is provided to transmit movement of the movement arm 330 to the weight stack. In the preferred embodiment it includes a vertical drive shaft or rod generally designated 350 which is connected at 357 to the movement arm 330 intermediate the ends thereof. Drive rod 350 is elongated and extends to the bottom area of the machine in the rear frame 312 as best shown in FIG. 20 where it is connected to the resistance weight stack by means of a linkage. The latter includes a main link or lever 344 having an intermediate portion pivotally connected by pivot pin 352 to the lower end of drive shaft 350. One end of lever 344 is pivotally connected at pivot pin 345 to the lower end of a stack pin 340 included in the resistance weight stack. The opposite end of the lever 344 is pivotally connected to the stationary frame 312 by means, in the preferred embodiment, of a link 346 having one end pivotally connected by pin 347 to the lever 344 and having an opposite end pivotally connected by pin 348 to the frame 312.

Referring to FIG. 20, it will be seen that when the drive shaft 350 is raised upon downward pivoting of the movement arm 330, this will cause the main link 344 to pivot upwardly to raise stack pin 342. Of course the opposite movement will occur when the drive shaft 350 is lowered when the user relieves force on the movement arm enabling the resistance weights to descend.

Any suitable resistance weight stack may be employed, however in the preferred embodiment a compound weight stack is utilized such as disclosed in my U.S. Pat. No. 4,834,365 entitled COMPOUND WEIGHT SYSTEM. The disclosure of my aforementioned Pat. No. 4,834,365 as well as my prior U.S. Pat. No. 5,149,313, identified above are hereby incorporated by reference into the instant application as part thereof. In the instant embodiment, the compound weight stack includes a frame 312*a* including first and second independent groups of weights, one weight being shown as 338 in FIG. 21. The upper group of weights is connectable to the stack pin 340 through means of apertures 341 which receive pins which extend through the weights in well-known manner. The lower group of weights is connectable in similar manner to the stack pin through means of the apertures 342 shown in FIG. 20.

As best shown in FIG. 19, the movement arm 330 is located a sufficient distance above the seated user so that the arms will be stretched when the movement arm is first grasped. As the user pivots the movement arm downwardly the muscles of the upper chest, backs, arms and shoulders will be exerted to lower the movement arm and overcome the resistance provided by the weights in the weight stack. After the movement arm has been lowered and the user relieves pressure, the weights of the resistance stack will return the movement arm to the raised position while the user continues to hold the handles 334 whereupon the exercise is repeated. In addition to the other advantages, it will also be seen that this machine makes chinning-type exercises possible for those individuals who do not have sufficient upper body strength to lift their own body weight.

SEATED DIP MACHINE

Figure 22:
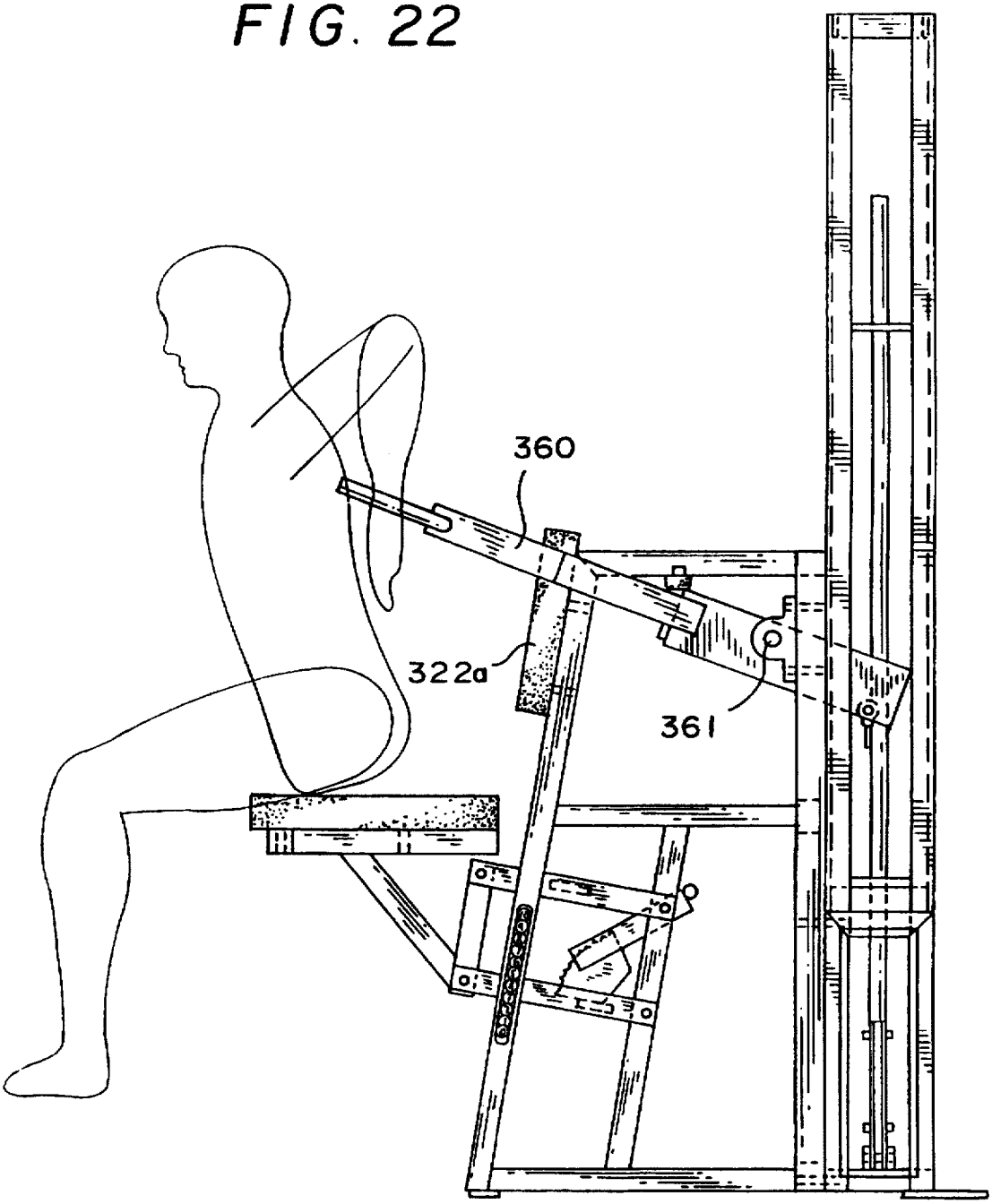
FIG. 22 is an end elevational view of a machine constituting another embodiment of the present invention.

Referring now to FIG. 22, there is shown another machine which may be termed a "seated dip" machine constituting another embodiment of the present invention which is generally similar to the machine shown in FIGS. 19 through 21 and described above. However, in the present machine the movement arm 360 is pivoted about the horizontal pivot shaft 361 at an elevation that is lower than that described above. This enables easy access to the movement arm by the user by placing the arms downwardly along the sides of the user's body thus allowing the users who do not have enough sufficient upper body strength, to perform the desired exercises.

OVERHEAD PRESS MACHINE

Figure 23:
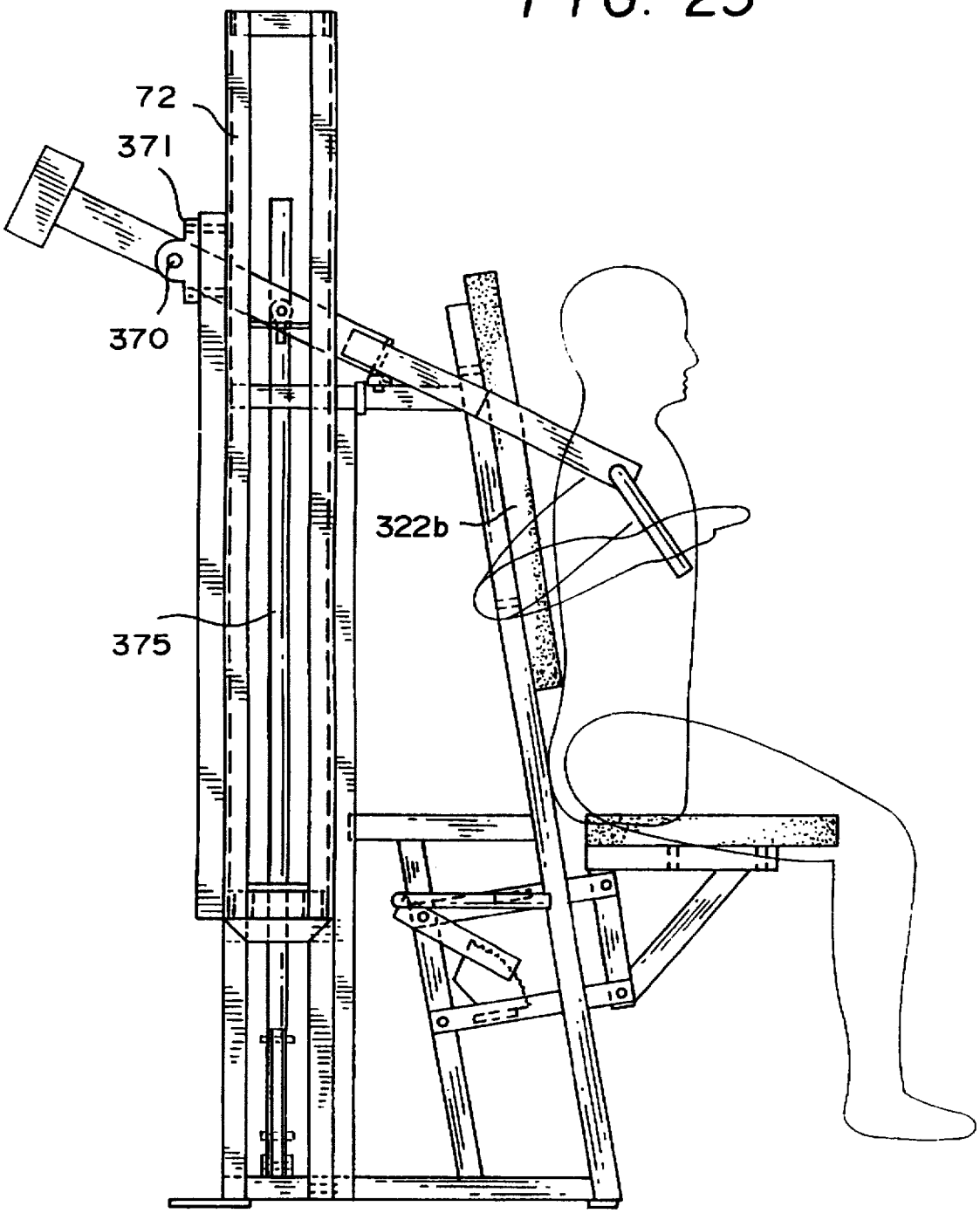
FIG. 23 is an end elevational view of another machine constituting another embodiment of the present invention.

Referring now to FIG. 23, there is shown a machine which may be termed "overhead press" machine constituting another embodiment of the present invention for exercising the upper chest, neck, shoulders and arms. In this machine the movement arm is pivoted on the horizontal pivot shaft 370 at a location rearwardly of the drive rod 375; the pivot shaft 370 being mounted in bearing blocks 371 secured to the frame as shown in FIG. 23. To perform the exercise with the present machine, the movement arm is raised against the resistance of the resistance weight stack to pivot the movement arm about the shaft 370 and to raise the drive rod 375 and in turn the resistance weights. As is the case in the above described embodiments, the backrest **322*b*** is angled rearwardly to allow the user to perform the exercise in a manner which will lessen the stress on the shoulders and help prevent rotary-cuff type injuries.

I claim:

1. A method of testing the lumbar muscles of a subject comprising the steps of having the subject exert his/her lumbar muscles against the opposition of a static resistance provided by a machine, measuring and displaying the static strength of the subject through the use of a computer and display screen connected to the machine, having the subject exert his/her lumbar muscles by moving his/her back rearwardly to perform positive work and forwardly to perform negative work within a range of movement of about seventy-two degrees against a movement arm of the machine by moving the movement arm in one direction to perform positive work by moving a resistance weight from a starting position against a resistance provided by the resistance weight which is connected to the movement arm and imposes a resistance force less than the static strength of the subject, then having the subject move the movement arm in a direction opposite said one direction to perform negative work and return said resistance weight towards said starting position and repeating said steps to move the movement arm in opposite directions until the muscles become fatigued and can no longer move the resistance weight, and measuring and displaying the dynamic strength of the subject including the positive and negative work performed through the forces applied by the subject to the movement arm through the use of a computer and display screen connected to the machine.

2. The method defined in claim 1 further including the steps of measuring the static strength of the subject at different positions of the subject and using the computer and display screen to display the measured static strength for each of the positions of the subject.

3. The method defined in claim 1 including the step of selecting a resistance weight less than the static strength of the subject.

4. The method defined in claim 1 including the steps of measuring and displaying the forces exerted on the movement arm by the subject through the use of the computer and lines across the display screen representing the level of force exerted by the muscles.

5. The method defined in claim 1 including the steps of measuring the static strength and dynamic strength of the subject at different times and comparing the measurements at different times.

6. The method defined in claim 1 further including the step of measuring the strength of the subject through the use of a strain gauge in the machine and connected to the computer and using the strain gauge to operatively interconnect the resistance weight and the movement arm.

7. The method defined in claim 6 wherein said strain gauge is connected between the movement arm and the resistance weight.

8. The method defined in claim 1 including the steps of measuring the number of repetitions of the movement arm the subject can achieve with a given resistance weight and determining the percentage that the resistance weight bears to the static strength of the subject.

9. The method defined in claim 1 including the step of isolating the muscles to be tested from other body parts of the subject and holding the other body parts in a predetermined position during movement of the movement arm by the subject.

10. The method defined in claim 9 applied to testing the lumbar muscles and wherein the pelvis of the subject is immobilized during the tests.

11. The method defined in claim 10 wherein the subject is seated on a seat with his legs restrained against movement during the tests.

12. The method defined in claim 9 wherein the subject is seated with his legs restrained against movement during the tests.

13. The method defined in claim 12 wherein an upwardly directed force is applied to the front of the legs to rotate the hip-ends of the femurs downwardly against the seat and a pelvic pad to restrain the legs against movement.

14. The method defined in claim 1 wherein the subject when moving in said one direction against the resistance weight moves smoothly and gradually avoiding jerky movements and when reaching the limit pauses to determine whether the subject can hold that position, then the subject returns in the direction opposite said one direction and upon reaching a limit in this direction immediately moves back in said one direction and repeats the exercise until the subject can no longer hold a position against the opposition of the resistance weight.

15. A machine for testing muscles of a human subject, the machine comprising in combination, means providing a static resistance to movement upon engagement by the subject and exertion of said muscles, means including a computer and display screen for measuring and displaying the static strength of said muscles upon engagement by the subject and exertion of said muscles, a movement arm mounted for movement in opposite directions between opposite positions in response to engagement by the subject upon exertion of said muscles, a resistance weight connected to the movement arm to oppose movement of said movement arm in one direction upon exertion of said muscle to perform positive work, said movement arm being movable in a direction opposite said one direction upon return movement of the subject to perform negative work, means including said computer and display screen for measuring and displaying the dynamic strength of said muscles in terms of positive and negative work upon engagement and exertion of said muscles to repeatedly move the movement arm in opposite directions between said positions, means for isolating muscles to be tested from other body parts of the subject and holding the other body parts in a predetermined position during movement of the movement arm by the subject including a seat for the subject and means for applying an upwardly directed force to the front of a seated subject's legs to rotate the hip-ends of the femurs downwardly against the seat and a pelvic pad to restrain the legs against movement, and means for determining the angular range of motion of a subject in moving the movement arm.

16. The machine defined in claim 15 wherein there is further included means releasably enaageable with the movement arm for fixing the movement arm to provide said static resistance.

17. The machine defined in claim 16 wherein said movement arm is movable about an axis upon engagement by the subject and exertion of said muscles, and wherein said means for measuring and displaying the static strength of said muscles measures and displays the static strength of said muscles at different angular positions of said movement arm.

18. The machine defined in claim 15 including a strain gauge interconnecting the movement arm and said resistance weight for measuring the strength of the muscles, said strain gauge being connected at one end to a member mounted about an axis of movement of the movement arm to thereby operatively connect the movement arm to the resistance weight.

19. The machine defined in claim 18 wherein said strain gauge is operatively connected to said computer.

20. The machine defined in claim 19 wherein said movement arm is movable about an axis in response to engagement by the subject upon exertion of said muscles, and wherein there is further included means connected to said computer for measuring the angular position of the movement arm.

21. The machine defined in claim 15 wherein said movement arm is movable about an axis in response to engagement by the subject upon exertion of said muscles, and wherein there is further included means connected to said computer for measuring the angular position of the movement arm.

22. The machine defined in claim 5 including a sprocket rotatable about an axis, a cable attached to the sprocket and operatively connected to the resistance weight, and means releasably connecting the movement arm to the sprocket.

23. The machine defined in claim 22 wherein said sprocket has a plurality of apertures angularly spaced about the rotational axis of the sprocket and said means connecting the movement arm to the sprocket includes a pin receivable in a selected one of said apertures.

24. The machine defined in claim 23 including a mounting member mounted about the rotational axis of the sprocket and holding said pin.

25. The machine defined in claim 24 wherein said means connecting the movement arm to the sprocket further includes a strain gauge connected to and between said movement arm and said mounting member to operatively interconnect the movement arm to the resistance weight.

26. The machine defined in claim 15 further including a weight stack having a plurality of weights including said resistance weight, and wherein said resistance weight is raised when the movement arm is moved in said one direction and lowered when the movement arm is moved in a direction opposite said one direction.

27. A method of testing the lumbar muscles of a subject comprising the steps of having the subject exert his/her lumbar muscles against the opposition of a static resistance provided by a machine, measuring and displaying on a graph the static strength of the subject, having the subject repeatedly exert his/her lumbar muscles by moving his/her back rearwardly to perform positive work and forwardly to perform negative work against a movement arm of the machine by moving the movement arm against a movable resistance connected to the movement arm and repeating this exercise until the muscles fatigue, and measuring and displaying on a graph the dynamic strength of the subject including the positive and negative work performed through the force applied by the subject to the movement arm to move the movement arm and movable resistance, and wherein the movable resistance is chosen to be less than the maximum static strength of the muscles.

28. The method defined in claim 27 further including the steps of measuring the static strength of the subject at different positions of the subject by exerting the muscles against the opposition of the static resistance at each of the different positions, and displaying on a graph the measured static strength for each of the positions of the subject.

29. The method defined in claim 27 including the steps of measuring the number of repetitions of the movement arm the subject can achieve with a given movable resistance and determining the percentage that the movable resistance force bears to the maximum static strength of the subject.

30. The method defined in claim 27 including the step of measuring the range of motion of the subject.

31. The method defined in claim 27 wherein the static strength of the subject is measured by fixing the position of the movement arm and having the subject exert the muscles against the movement arm while in fixed position.

32. A method of testing the lumbar muscles of a subject with the use of a resistance and a movement arm connected to the resistance, the method comprising the steps of, conducting a static strength test including the steps of holding the movement arm in a fixed position and having the subject exert the lumbar muscles against the movement arm while held in a fixed position, measuring the maximum static strength of the subject as the subject exerts the lumbar muscles against the held movement arm, releasing the movement arm after the subjects maximum static strength is measured and then testing the dynamic strength of the subject by having the subject exert the lumbar muscles against the movement arm rearwardly to perform positive work and forwardly to perform negative work against the resistance and measuring the dynamic strength of the subject through the force applied by the subject to the movement arm to move the movement arm and the resistance, and wherein for the dynamic strength test the resistance is chosen to provide a resistive force less than the maximum static strength of the subject and wherein the method further includes during the dynamic strength test, the steps of having the subject repeatedly move the movement arm until the muscles become fatigued and can no longer move the movement arm.

33. The method defined in claim 32 including, during the dynamic strength test, the steps of measuring the number of repetitions of the movement arm the subject can achieve with a given resistance and determining the percentage that the resistance force of the resistance bears to the maximum static strength of the subject.

34. A method of testing muscles of a subject comprising the steps of having the subject exert his/her muscles against the opposition of a static resistance provided by a machine, measuring and displaying the static strength of the subject through the use of a computer and display screen connected to the machine, having the subject exert his/her muscles against a movement arm of the machine to move the movement arm against a resistance provided by a resistance weight connected to the movement arm, isolating muscles to be tested from other body parts of the subject and holding the other body parts in a predetermined position during movement of the movement arm by the subject by having the subject sit on a seat and applying an upwardly directed force to the front of the subject's legs to rotate the hip-ends of the femurs downwardly against the seat and a pelvic pad to restrain the legs against movement and measuring and displaying the dynamic strength of the subject through the force applied by the subject to the movement arm through the use of a computer and display screen connected to the machine.

* * * * *